US011591876B1

(12) United States Patent
Evans et al.

(10) Patent No.: US 11,591,876 B1
(45) Date of Patent: Feb. 28, 2023

(54) TIME-CONTROLLED CABLE-HEAD CUTTER FOR LINE CONVEYED TOOLS

(71) Applicant: TimeSaver Downhole Products, LLC, Montgomery, TX (US)

(72) Inventors: Robert W. Evans, Montgomery, TX (US); Chet Brame, Montgomery, TX (US); Homero Castillo, Montgomery, TX (US)

(73) Assignee: TimeSaver Downhole Products, LLC, Montgomery, TX (US)

( * ) Notice: Subject to any disclaimer, the term of this patent is extended or adjusted under 35 U.S.C. 154(b) by 0 days.

(21) Appl. No.: 17/501,861

(22) Filed: Oct. 14, 2021

(51) Int. Cl.
*E21B 29/02* (2006.01)
*E21B 29/04* (2006.01)

(52) U.S. Cl.
CPC ..... *E21B 29/02* (2013.01); *E21B 29/04* (2013.01)

(58) Field of Classification Search
CPC ..... E21B 29/02; E21B 29/04
See application file for complete search history.

(56) References Cited

U.S. PATENT DOCUMENTS 2,825,536 A * 3/1958 Kenneday ..... E21B 29/04 166/54.5
3,036,522 A * 5/1962 Lindsey ..... B26F 3/04 114/221 R
4,237,972 A * 12/1980 Lanmon, II ..... B23D 15/145 166/54.5
6,763,753 B1 * 7/2004 Brumley ..... E21B 29/04 83/639.1
2014/0000895 A1 * 1/2014 Misselbrook ..... E21B 29/04 166/55

* cited by examiner

*Primary Examiner* — Christopher J Sebesta
(74) *Attorney, Agent, or Firm* — Tumey L.L.P.

(57) ABSTRACT

A cable head line cutter tool comprising an internal mandrel anchored to a line and releasably held in an initial position by a locking mechanism disposed within an outer housing of the cable head cutter tool. When a tensile load is applied to the line sufficient to overcome a mechanical resistance acting upon the locking mechanism, and maintained for a duration sufficient to overcome a hydraulic resistance acting upon the locking mechanism, the internal mandrel may become released from the locking mechanism and allowed to travel within the outer housing free of the locking mechanism. In embodiments, the cable head line cutter tool may comprise one or more such locking mechanisms acting independently or in coordination. If the tensile load applied to the line is sufficient to release the mandrel from each of the one or more locking mechanisms and maintained for sufficient duration, the mandrel may cause a line cutter device disposed within the cable head line cutter tool to cut the line. Alternatively, the mandrel may be returned to the initial position prior to cutting the line by reducing or relaxing the tensile load applied to the line.

12 Claims, 10 Drawing Sheets

100
111
160
110
142
107
108
109
103
105
106
104
141
140
149
415
413
102
412
414
410
411
101
149
401
401
100

100
122
146
121
145
120
118
119
186
185
180
184
181
183
182
117b
117a
170
168
117
169
144
116
115
112a
114
113
112
143
164
165
162
166
167
162
161
162
142
111
401

447
448
445
446
440
444
441
444
442
443
434
433
432
430
132
431
424
423
422
421
420
131
130
130
128
129
127
127
148
153
126
154
152
151
150
401
125
147
124
124
122
123
118
146
100

100
111
110
142
107
108
109
103
106
105
104
141
140
149
415
413
102
412
414
410
411
101
149
401
401
100

100
122
146
121
145
120
118
119
186
185
180
184
181
183
117b
182
117a
170
168
117
169
144
116
115
112a
114
113
112
143
164
162
165
167
166
162
161
162
111
401

448
447
446
445
441
444
440
443
442
434
433
432
430
431
132
424
423
421
420
422
131
130
130
128
129
127
127
148
153
126
154
152
151
150
401
125
147
124
124
122
123
118
146
100

200
215
214
212
260
211
244
242
207
208
203
205
240
202
415
414
249
201
401
413
412
410
411
216
213
243
210
209
206
204
241

247
223
221
222
246
219
224
245
220
287
286
285
282
280
284
283
281
218b
218a
265
266
264
263
268
267
218
262
261
217
212
260

448
447
446
445
444
443
441
440
442
434
433
432
430
431
232
424
231
422
423
421
420
230
228
229
227
248
253
226
254
252
251
250
225
246
223a
401
247

200
215
214
212
260
211
244
242
207
208
203
205
240
202
415
414
249
401
201
216
213
243
210
209
206
204
241
413
412
410
411
401
223
246
221
222
219
287
286
282
218b
218a
265
266
264
263
218
244
262
261
212
217
401
224
247
245
220
285
280
284
283
281
268
267
448
447
446
445
444
443
434
432
231
424
422
230
228
227
248
251
252
226
223a
223
401
440
441
442
433
430
431
423
420
421
229
253
254
250
225

300
361
362
360
315
314
312
344
317
316
313
343
342
311
310
309
307
308
303
305
306
304
340
341
302
415
349
413
410
412
414
411
401
301
349
401
300
300
326
327
345
324
396
325
394
395
390
391
393
392
323b
323a
371
323
369
370
322
321
319
321
320
386
382
385
380
384
383
381
318b
318a
365
366
364
368
367
363
364
318
344
362
361
401

300
448
447
446
445
444
440
441
443
442
434
433
432
430
431
338
424
423
421
420
422
337
336
336
334
335
333
333
332
353
354
352
351
350
331
347
330
330
329
328
326
346
327
401
300

TIME-CONTROLLED CABLE-HEAD CUTTER FOR LINE CONVEYED TOOLS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

This invention relates generally to mechanical devices used in wells such as oil and gas wells. More particularly, apparatuses and methods are provided for cutting a line used to deploy a tool in a well if the tool becomes stuck in the well. A line may be a slickline, braided line, electromechanical line, flexible rod, or coiled tubing.

Background of the Invention

In this application, the terms "wireline" and "wireline cable" may generically refer an electromechanical line having one or more conductors.

A variety of mechanical devices or tools are used in wells, for such purposes as logging the properties of the formation surrounding the well, taking samples of the formation, perforating the formation and/or wellbore casing, well intervention, and other purposes. During such operations, commonly performed using a wireline, an accumulation of material within the hole, high differential pressure between the wellbore and the rock formations, or the occurrence of mechanical or hydraulic malfunctions, may present operational complications making it impossible to retrieve a tool from a well using the wireline supporting the tool. Other factors which may contribute to tools becoming stuck may include the length and profile of the wellbore, for example wherein doglegs may contribute to the tool experiencing increased drag, or the weight of the tools themselves. Under these circumstances it may be desirable to release the line from the tool that is lodged in the well, allowing the tool to be retrieved using more suitable equipment.

Different mechanisms suitable for releasing a line from a stuck tool are known in the art. For example, U.S. Pat. No. 5,109,921 discloses a releasable tool with first and second shear pin arrangements. U.S. Pat. No. 5,568,836 discloses a release device having a latch mechanism and a time delay mechanism that is actuated after a time interval has elapsed. However, existing technologies and techniques are typically limited in their ability to flexibly adapt to conditions which may be encountered in the field.

In many wireline retrieval operations, particularly tight hole operations, it may often be desirable to apply a tensile load on the wireline in an attempt to free the stuck tool without cutting the wireline. For example, an operator may find it desirable to slowly increase tension on the wireline, and then hold the tension for an extended period of time to try to dislodge the tools without triggering the cutting device. In another example, the operator may desire to apply an overload tension in excess of the triggering load of the cutting device to try to dislodge the tool without triggering the cutting device. With most conventional cutting devices, application of a tensile load over a long period of time and application of an overload tension may cause the cutting device to be inadvertently triggered.

Consequently, there remains a need in the art for wireline cutting devices which allow the triggering load to be exceeded for a finite period of time without causing the wireline to be cut, and this need in the art extends equally to other forms of lines which may be used to convey a tool in a well. Such cutting devices would be particularly well received if they provided the operator the option of reducing the line tension shortly after the over-pull to avoid cutting the wireline, or maintaining the over-pull to trigger the wireline to be cut.

BRIEF SUMMARY OF SOME OF THE PREFERRED EMBODIMENTS

While the embodiments that follow are directed to applications comprising an electromechanical line having one or more conductors, it should be understood that each embodiment may alternatively comprise other forms of lines allowing conveyance of wellbore tools, including, but not limited to, slicklines, braided lines, electromechanical lines, flexible rod, coiled tubing, or similar means of conveyance.

These and other needs in the art are addressed in a first embodiment by a time-controlled cable-head cutter tool comprising a single-trigger mechanism adapted for use in wellbore applications with line conveyed tools. The first embodiment may comprise an outer housing, a mandrel adapted for longitudinal movement within the housing, a pressure piston comprising a restrictor orifice and one or more check valves, a biasing mechanism acting against the pressure piston, an adjustable triggering mechanism, a biasing mechanism acting against the adjustable triggering mechanism, a balancing piston, a mechanical or non-mechanical cutting mechanism disposed at a first end of the cable-head cutter tool, and a connection housing disposed at a second end of the cable-head cutter tool wherein a wireline cable may be terminated.

These and other needs in the art are addressed in a second embodiment by a time-controlled cable-head cutter tool comprising an alternate arrangement of a single-trigger mechanism adapted for use in wellbore applications with line conveyed tools. The second embodiment may comprise an outer housing, a mandrel adapted for longitudinal movement within the housing, a pressure piston comprising a restrictor orifice and one or more check valves, a biasing mechanism acting against the pressure piston, an adjustable triggering mechanism, a balancing piston, a mechanical or non-mechanical cutting mechanism disposed at a first end of the cable-head cutter tool, and a connection housing disposed at a second end of the cable-head cutter tool wherein a wireline cable may be terminated.

These and other needs in the art are addressed in a third embodiment by a time-controlled cable-head cutter tool comprising a dual-trigger mechanism adapted for use in wellbore applications with line conveyed tools. The third embodiment may comprise an outer housing, a mandrel adapted for longitudinal movement within the housing, a pressure piston comprising a restrictor orifice and one or more check valves, a biasing mechanism acting against the pressure piston, a first non-adjustable triggering mechanism, a second adjustable triggering mechanism, a biasing mechanism acting against the adjustable triggering mechanism, a balancing piston, a mechanical or non-mechanical cutting mechanism disposed at a first end of the cable-head cutter tool, and a connection housing disposed at a second end of the cable-head cutter tool wherein a wireline cable may be terminated.

Each of the three embodiments may allow a wireline cable passing longitudinally along a central axis of the cable-head cutter tool to be cut based upon a predetermined load being applied to the cable-head cutter tool, after a predetermined time delay has been passed, or combinations thereof. Alternatively, each of the three embodiments may allow the cable-head cutter tool to be reset to an initial configuration without having cut the wireline cable by reducing or relaxing the load applied to the cable-head cutter tool.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

In the following description the term proximal is used to describe the portion of the part being referred to that is closest to the well opening, or well mouth, and the term distal is used to refer to the portion of the part being referred to that is furthest from the well opening. Although the embodiments that follow illustrate applications comprising a wireline having one or more conductors, it should be understood that each embodiment may alternatively comprise other forms of lines allowing conveyance of wellbore tools, including, but not limited to, slicklines, braided lines, electromechanical lines, flexible rod, coiled tubing, or similar means of conveyance.

Figures 1A, 1B, 1C:
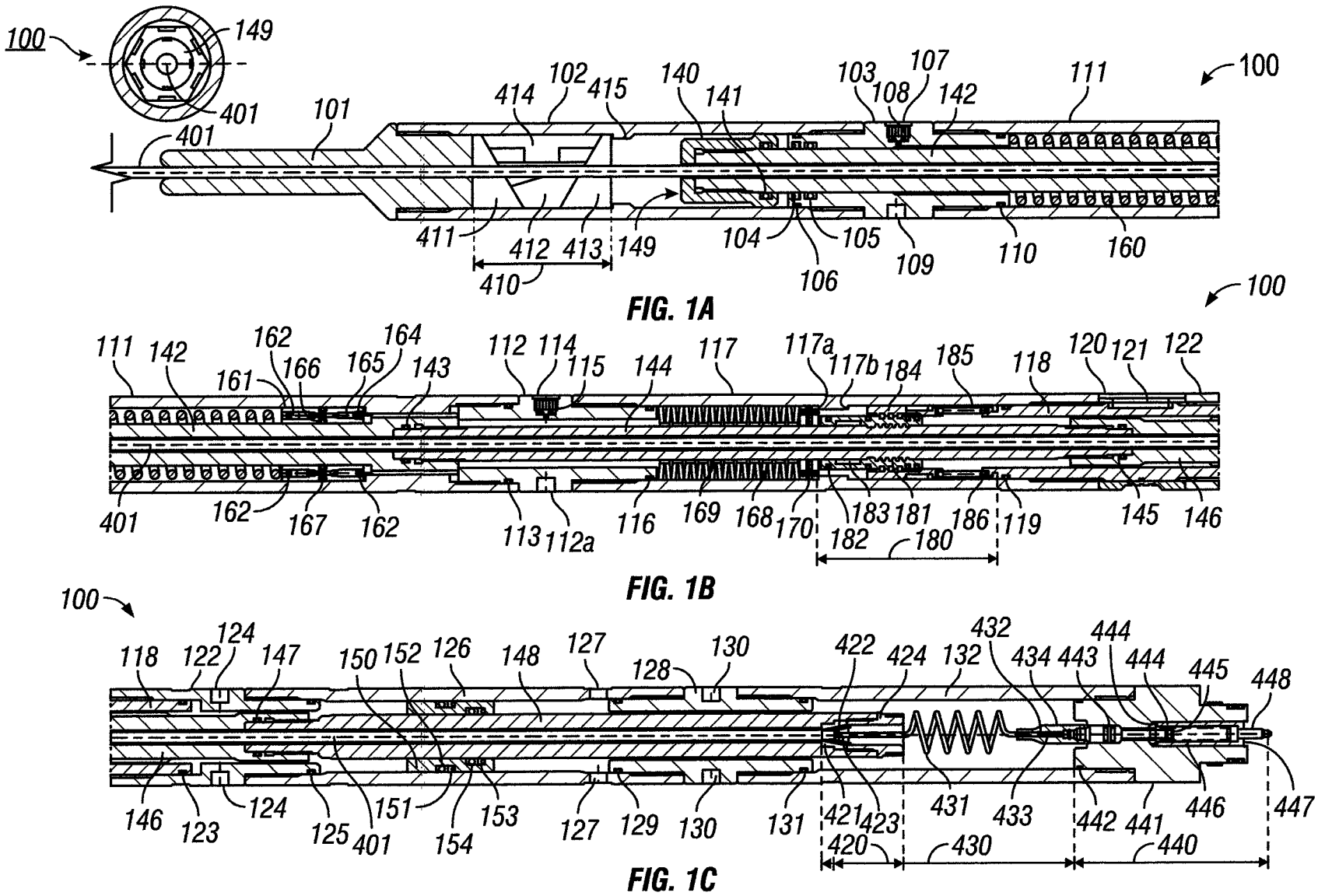
FIGS. 1*a-c* illustrate an embodiment of a time-controlled cable-head cutter apparatus comprising a single-trigger mechanism in a closed configuration.
Figures 2A, 2B, 2C:
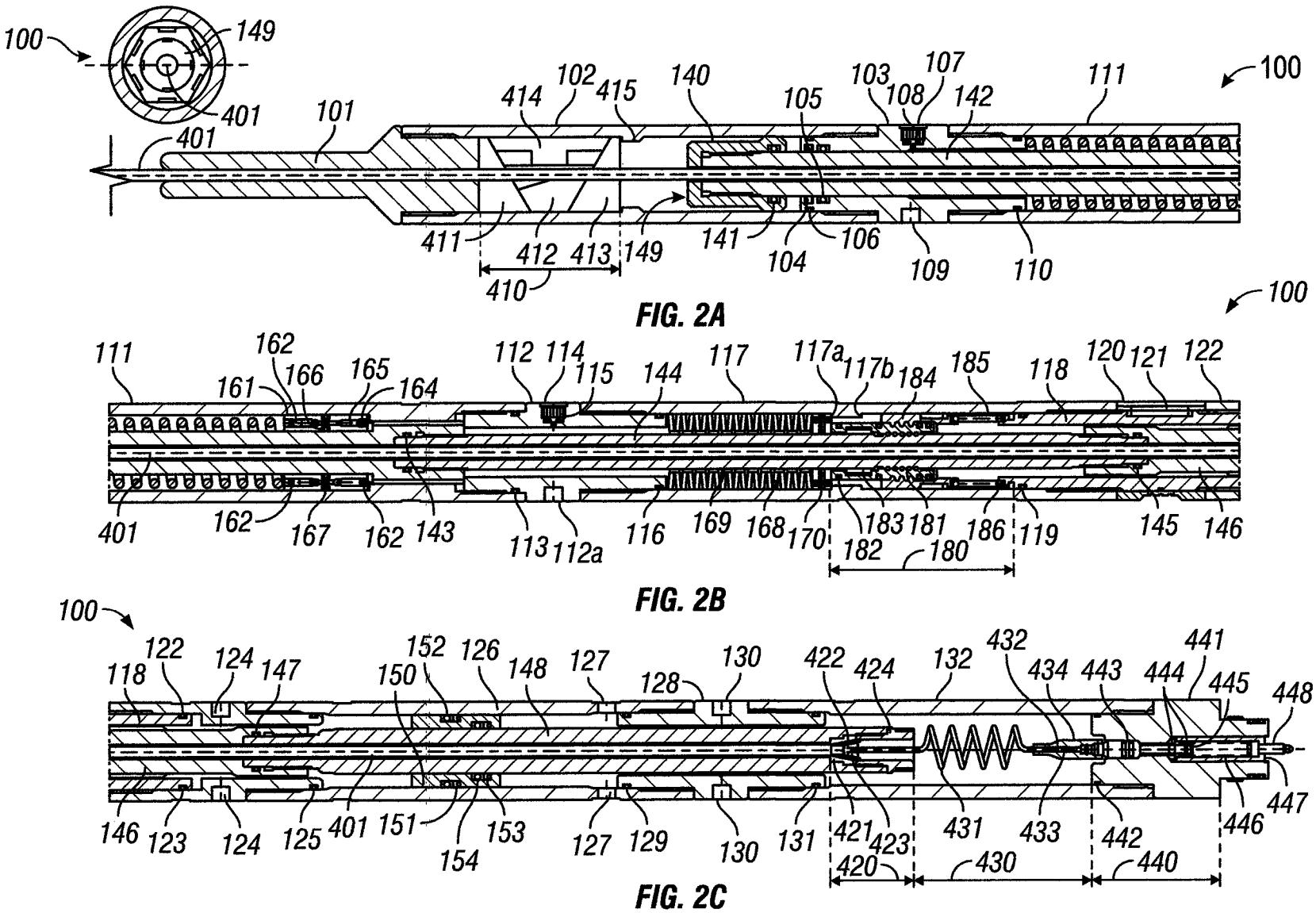
FIGS. 2*a-c* illustrate an embodiment of a time-controlled cable-head cutter apparatus comprising a single-trigger mechanism in a released configuration.
Figure 3A:
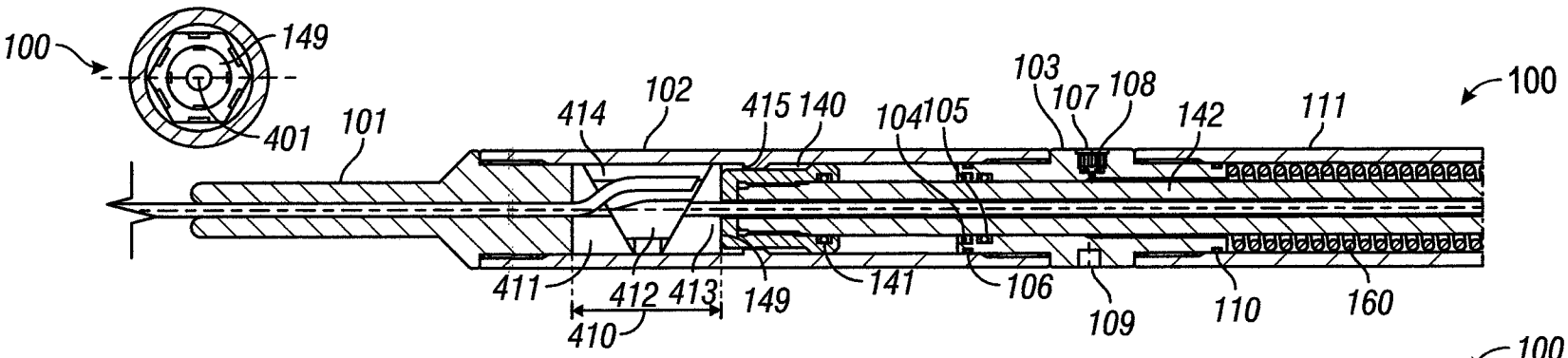
FIGS. 3*a-c* illustrate an embodiment of a time-controlled cable-head cutter apparatus comprising a single-trigger mechanism in a released configuration after a wireline cable has been cut.
Figure 3B:
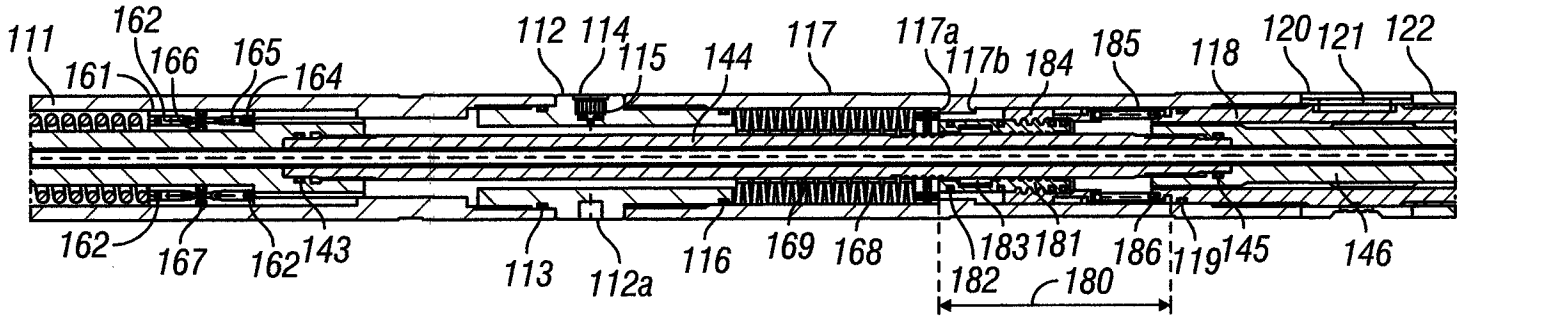
Figure 3C:
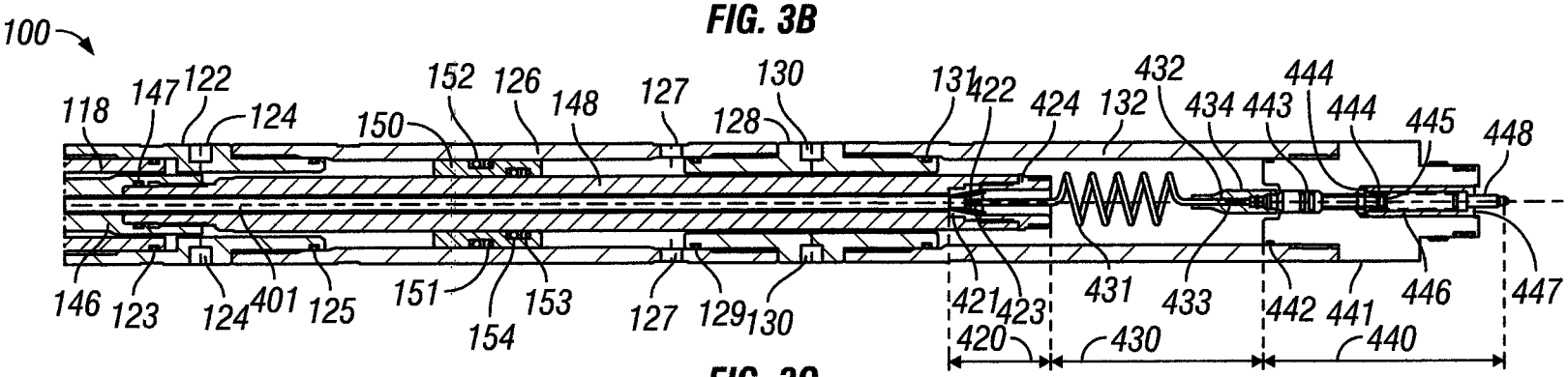

FIGS. 1*a* through 1*c*, 2*a* through 2*c*, and 3*a* through 3*c* illustrate an embodiment of time-controlled cable-head cutter tool 100 comprising a single-trigger mechanism adapted for use in wellbore applications with wireline conveyed tools. FIGS. 1*a* through 1*c* illustrate cable-head cutter tool 100 in a closed configuration, FIGS. 2*a* through 2*c* illustrate cable-head cutter tool 100 in a released configuration, and FIGS. 3*a* through 3*c* illustrate cable-head cutter tool 100 in a released configuration after wireline cable 401 has been cut.

Figures 4A, 4B, 4C:
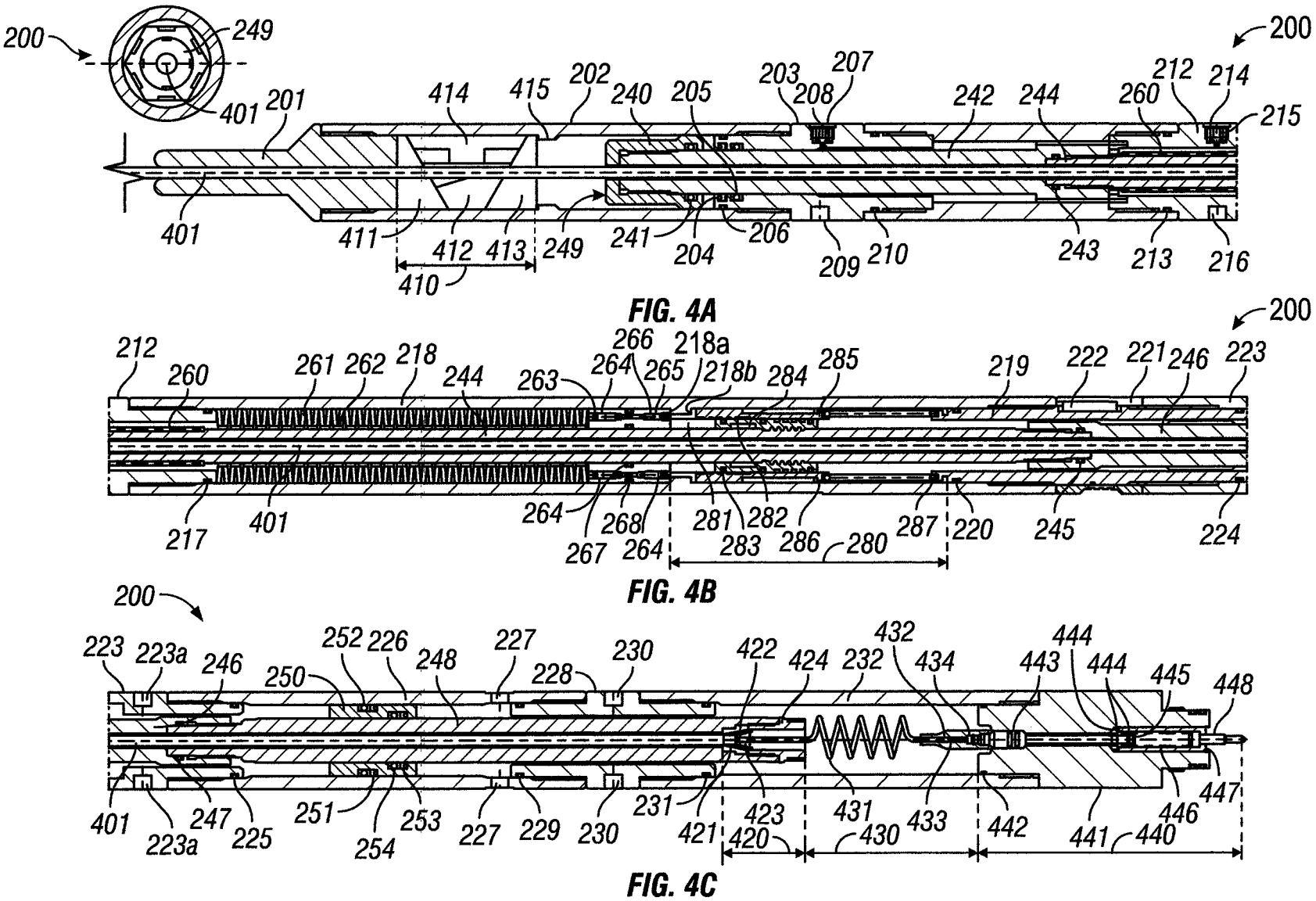
FIGS. 4*a-c* illustrate an alternate embodiment of a time-controlled cable-head cutter apparatus comprising a single-trigger mechanism in a closed configuration.
Figures 5A, 5B, 5C:
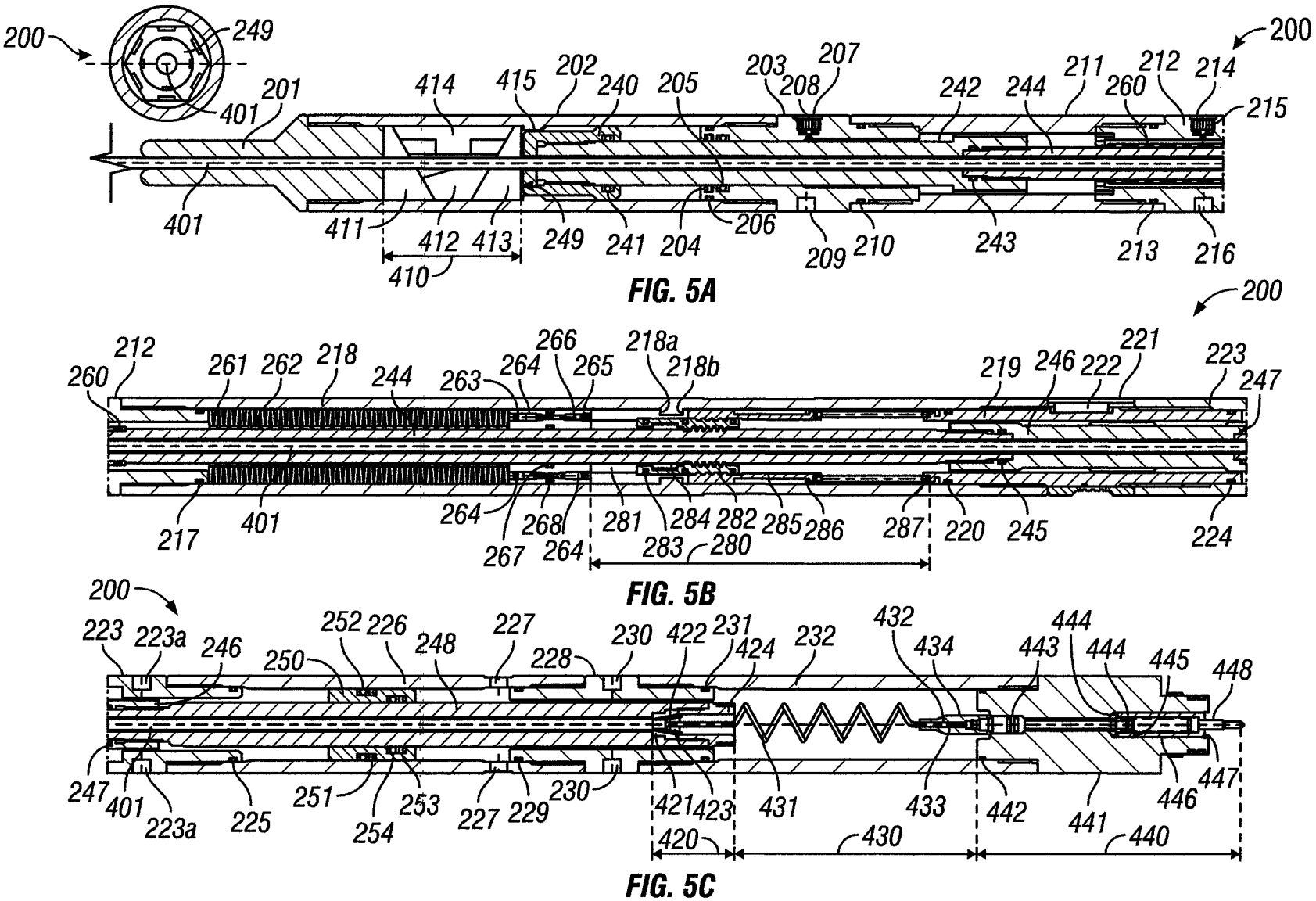
FIGS. 5*a-c* illustrate an alternate embodiment of a time-controlled cable-head cutter apparatus comprising a single-trigger mechanism in a released configuration.
Figures 6A, 6B, 6C:
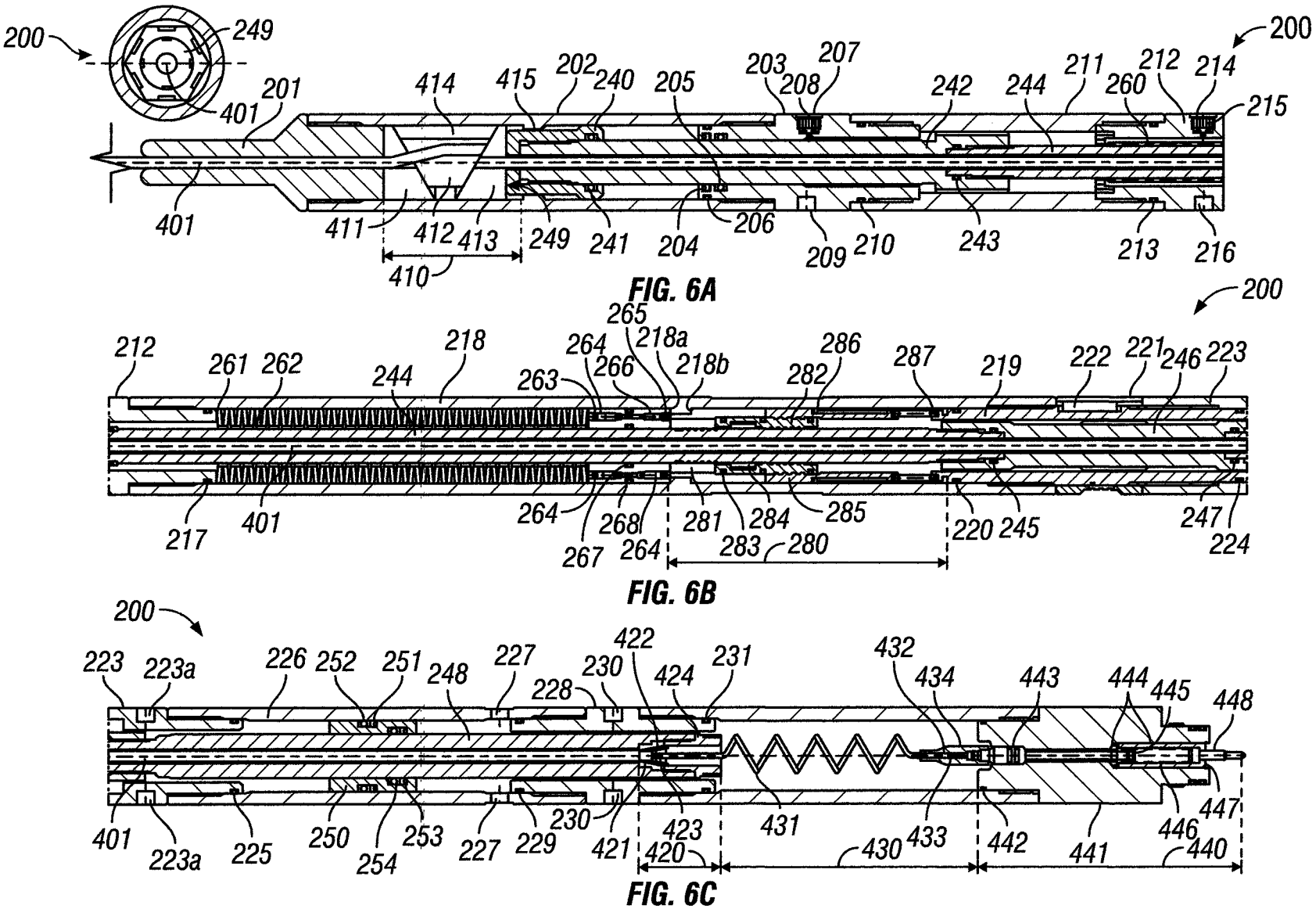
FIGS. 6*a-c* illustrate an alternate embodiment of a time-controlled cable-head cutter apparatus comprising a single-trigger mechanism in a released configuration after a wireline cable has been cut.

FIGS. 4*a* through 4*c*, 5*a* through 5*c*, and 6*a* through 6*c* illustrate an embodiment of time-controlled cable-head cutter tool 200 comprising a single-trigger mechanism adapted for use in wellbore applications with wireline conveyed tools. FIGS. 4*a* through 4*c* illustrate cable-head cutter tool 200 in a closed configuration, FIGS. 5*a* through 5*c* illustrate cable-head cutter tool 200 in a released configuration, and FIGS. 6*a* through 6*c* illustrate cable-head cutter tool 200 in a released configuration after wireline cable 401 has been cut.

Figures 7A, 7B, 7C:
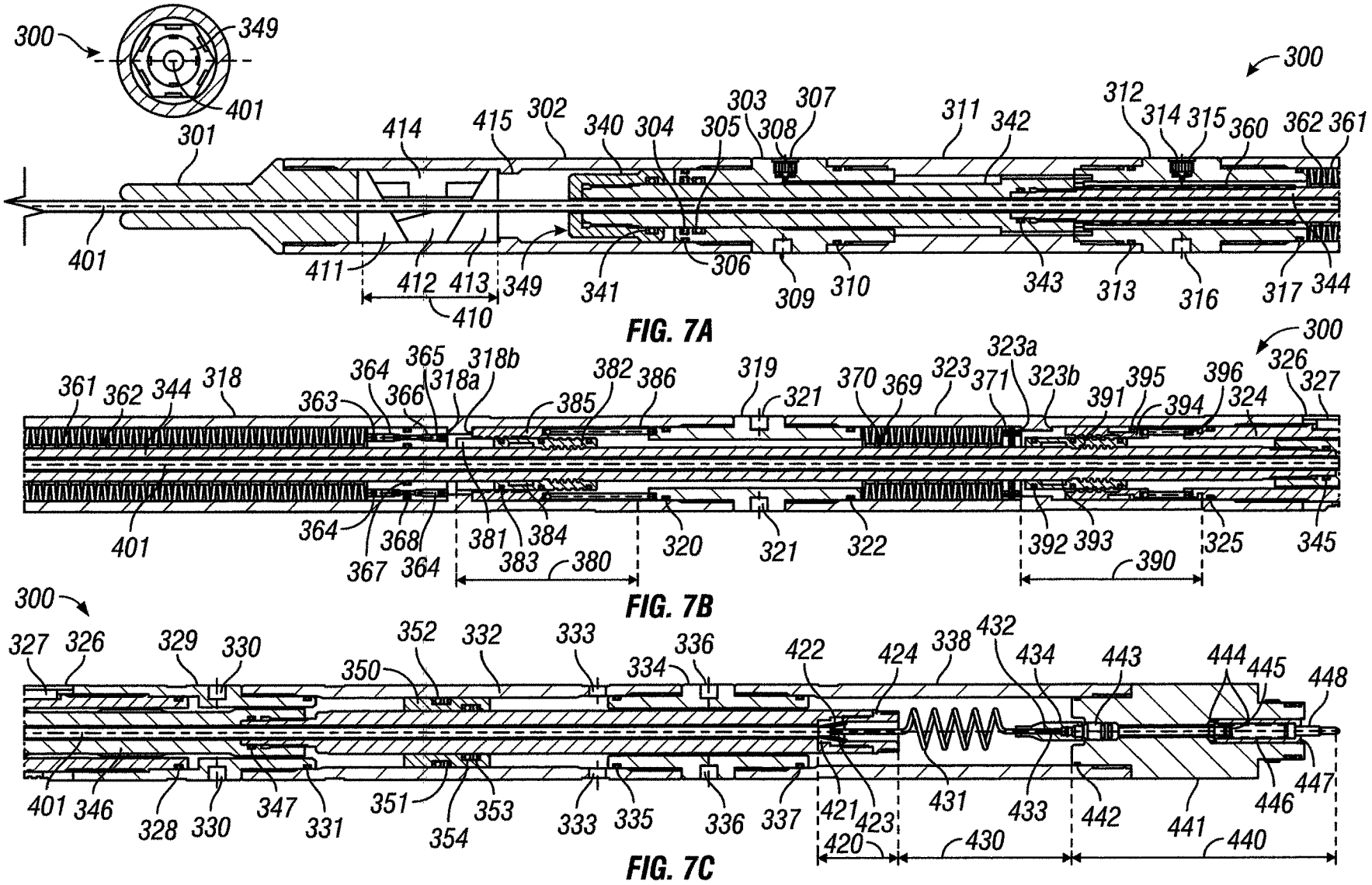
FIGS. 7*a-c* illustrate an embodiment of a time-controlled cable-head cutter apparatus comprising a dual-trigger mechanism in a closed configuration.
Figures 8A, 8B, 8C:
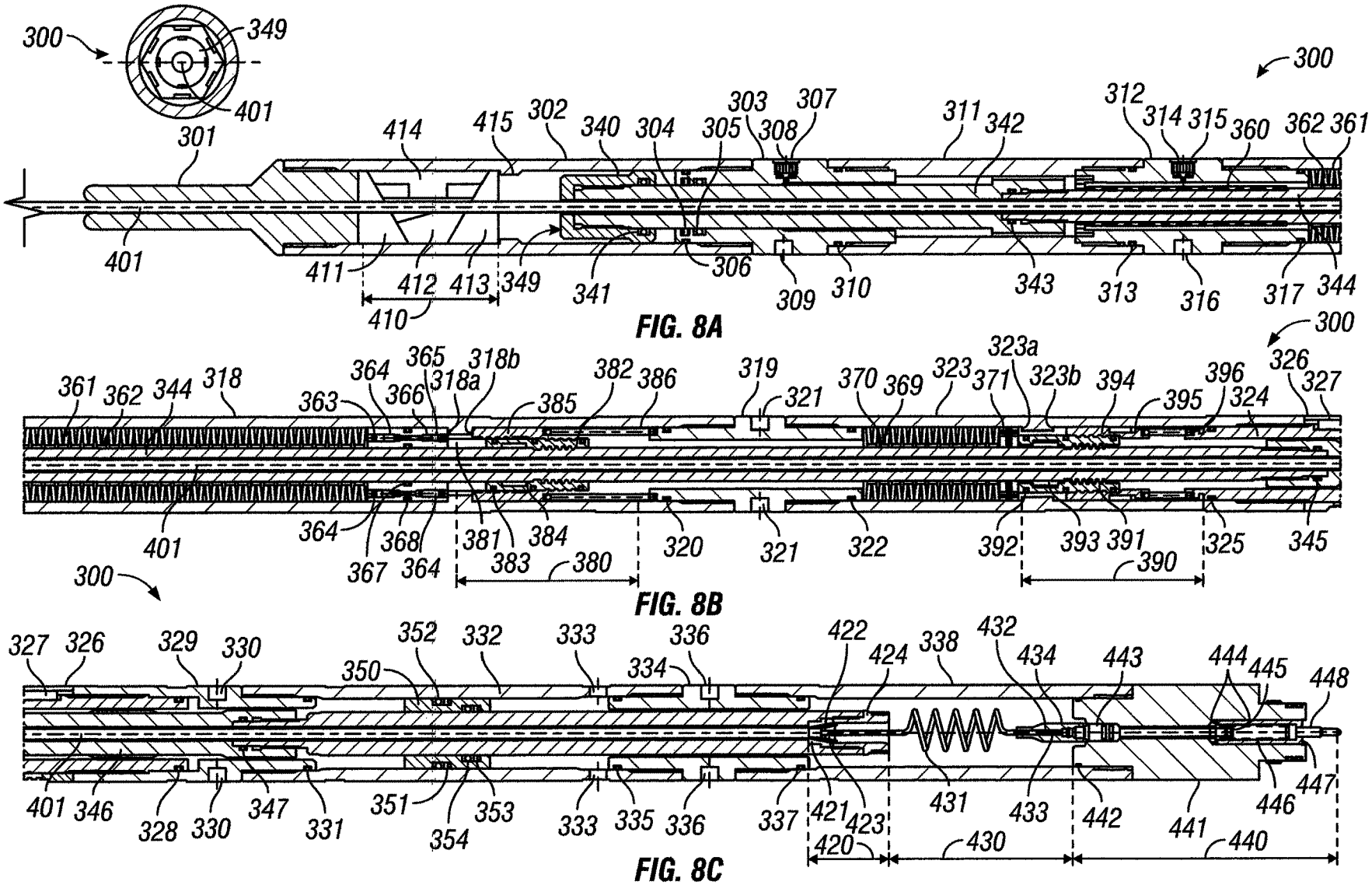
FIGS. 8*a-c* illustrate an embodiment of a time-controlled cable-head cutter apparatus comprising a dual-trigger mechanism in a first released configuration.
Figures 9A, 9B, 9C:
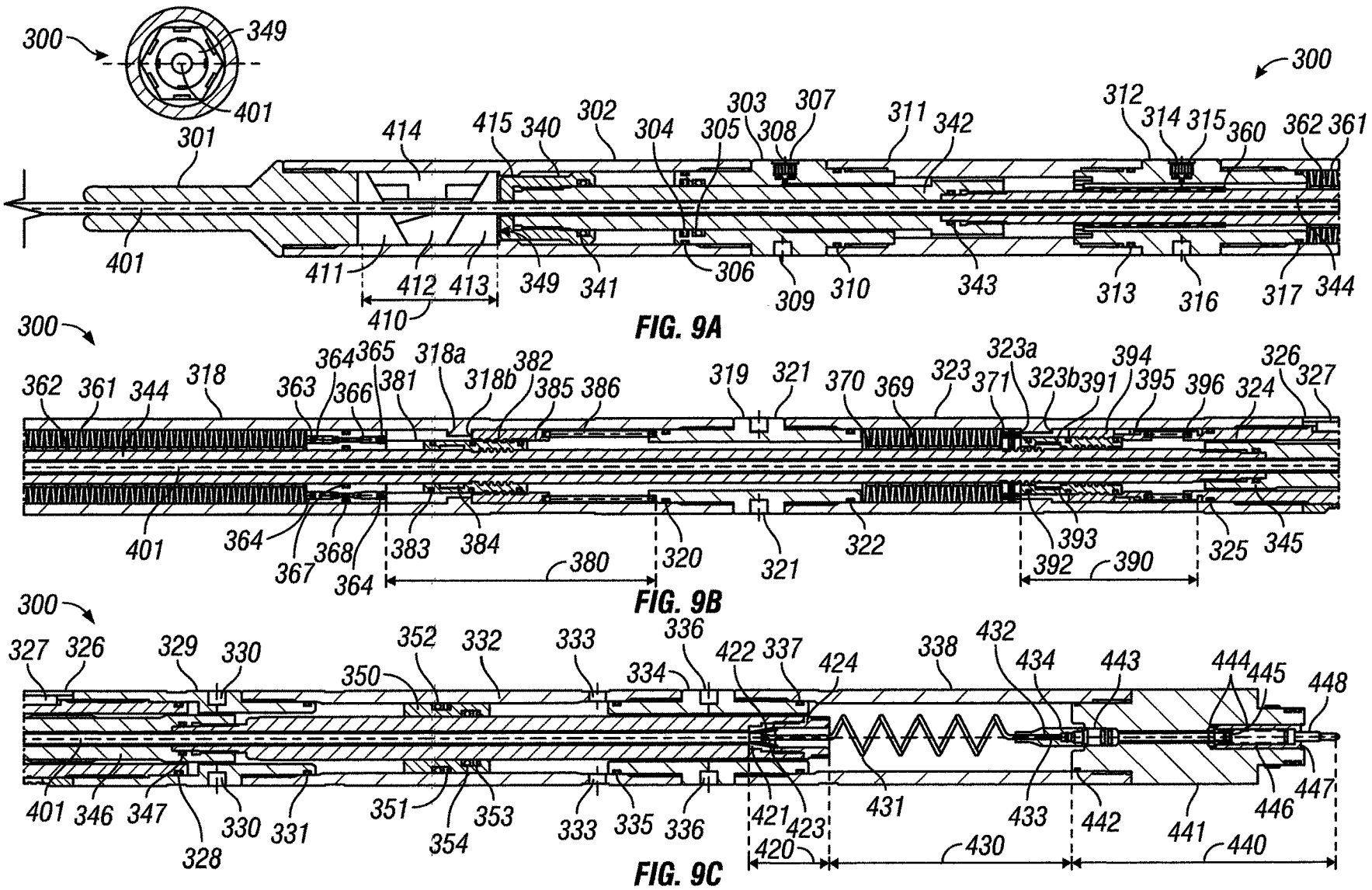
FIGS. 9*a-c* illustrate an embodiment of a time-controlled cable-head cutter apparatus comprising a dual-trigger mechanism in a second released configuration.
Figures 10A, 10B, 10C:
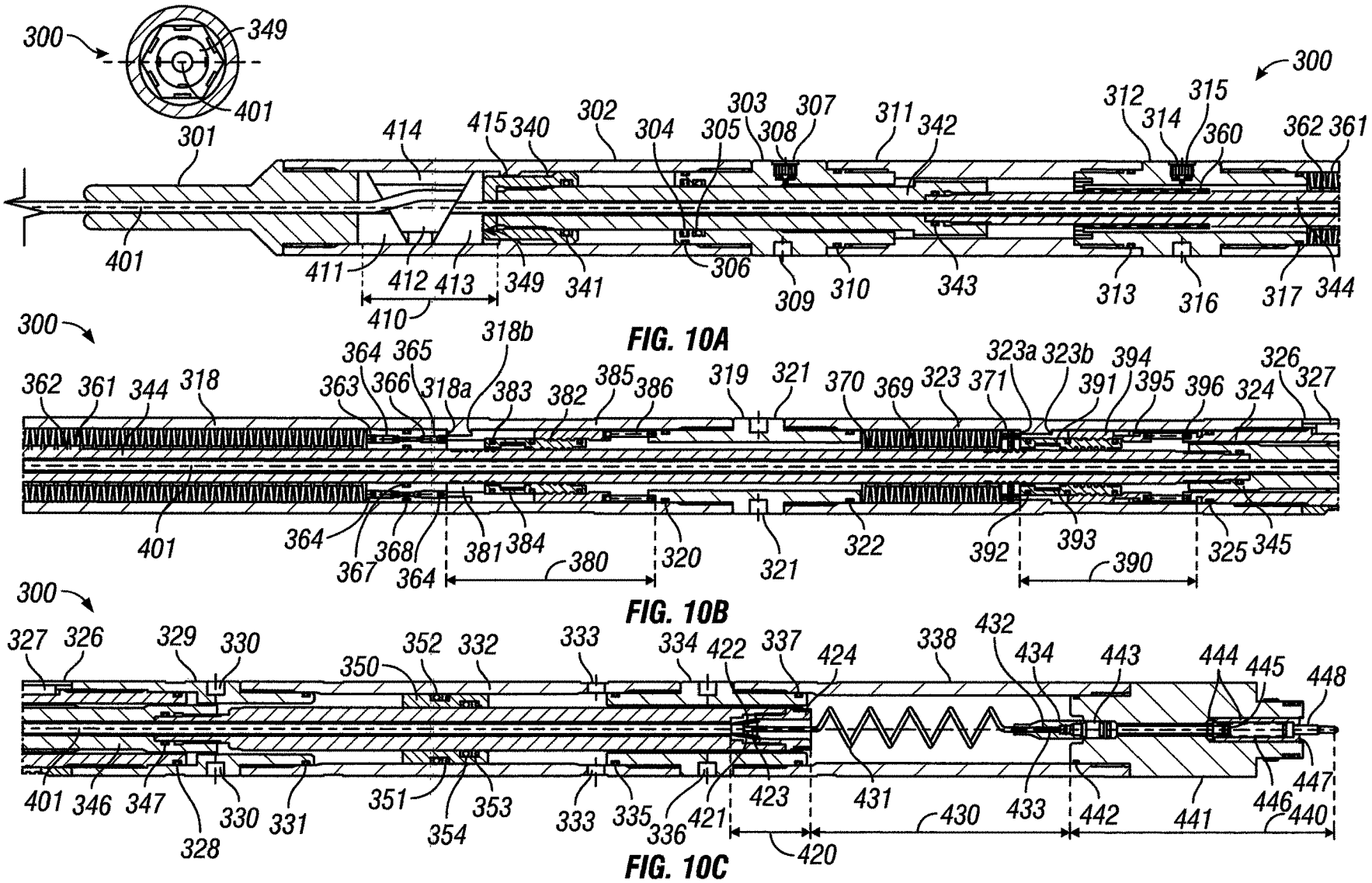
FIGS. 10*a-c* illustrate an embodiment of a time-controlled cable-head cutter apparatus comprising a dual-trigger mechanism in a released configuration after a wireline cable has been cut.

FIGS. 7*a* through 7*c*, 8*a* through 8*c*, 9*a* through 9*c*, and 10*a* through 10*c* illustrate an embodiment of time-controlled cable-head cutter tool 300 comprising a dual-trigger mechanism adapted for use in wellbore applications with wireline conveyed tools. FIGS. 7*a* through 7*c* illustrate cable-head cutter tool 300 in a closed configuration, FIGS. 8*a* through 8*c* illustrate cable-head cutter tool 300 in a first released configuration, FIGS. 9*a* through 9*c* illustrate cable-head cutter tool 300 in a second released configuration, and FIGS. 10*a* through 10*c* illustrate cable-head cutter tool 300 in a released configuration after wireline cable 401 has been cut.

In embodiments, wireline cable 401 may be any known wireline cable suitable for use in wellbore applications with wireline conveyed tools, including electromechanical cable, braided cable, slick line cable, or similar wireline cable, and may comprise a specified maximum suggested working tension. Examples of such wireline cables may include, but not be limited to Camesa® wireline cables such as 1N29-EHS, 1N32-EEHS, 1Q36-EHS ECOSEAL, 7H47-EHS, 7H49-EEHS, and Schlumberger® wireline cables such as StreamLINE and TuffLINE. Wireline cable 401 may be configured to enter a proximal end, extend through an axially centered channel, and terminate at a distal end of cable-head cutter tool 100,200,300.

Time-controlled cable-head cutter tool 100,200,300 may be comprised of an outer housing or casing, a mandrel, and a plurality of additional parts, components, or elements configured to function together which may allow wireline cable 401, passing longitudinally along a central axis from a proximal end of cable-head cutter tool 100,200,300 to a terminating connection 420 at a distal end of cable-head cutter tool 100,200,300, to be cut by cutting mechanism 410 based upon a predetermined load being applied to cable-head cutter tool 100,200,300, after a predetermined time delay has been passed, or combinations thereof. Alternatively, the configuration of cable-head cutter tool 100,200,300 may allow cable-head cutter tool 100,200,300 to be reset to an initial configuration without having cut wireline cable 401.

The outer housing system may be generally tubular in shape, and may be comprised of several sections, components, or parts which may be connected to each other, including fishing neck 101,201,301, cutter housing 102,202,302 seal housing 103,203,303, drive housing 111,211,311, filling sub 112,212,312, release housing 117,218,318, adjustment housing 122,223,329, balance housing 126,226,332, floater sub 128,228,334, and connection housing 132,232,338, each having similar outer diameters. The outer housing may further comprise release sub 319 and pressure housing 323 (in the third embodiment). The mandrel may extend longitudinally within the casing and may be comprised of several sections, components, or parts which may be connected to each other, including cutter press 140,240,340, drive mandrel 142,242,342 release mandrel 144,244,344 connector mandrel 146,246,346 and balance mandrel 148,248,348. A first annular fluid chamber between the housing and mandrel may be formed beginning at the distal portion of seal housing 103,203,303 and through the central portion of cable-head cutter tool 100,200,300 to a proximal portion of balance housing 126,226,332 located proximally relative to balancing piston 150,250,350.

Fishing neck 101,201,301 may be formed in any known manner, using a known design which may allow cable-head cutter tool 100,200,300 to be fished from a wellbore after wireline cable 401 has been cut. Fishing neck 101,201,301 may further be formed having a reduced diameter distal portion adapted for threaded connection to a proximal portion of cutter housing 102,202, 302, and may provide an axially centered channel through which wireline cable 401 may be run.

Cutter housing 102,202,302 may be formed having an internally threaded proximal portion adapted for threaded connection to the reduced diameter distal portion of fishing neck 101,201,301, and an internally threaded distal portion adapted for threaded connection to a reduced diameter proximal portion of seal housing 103,203,303. Cutter housing 102,202,302 may be configured having an internal profile adapted for housing any known cable cutting mechanism 410, and may provide an axially centered channel through which wireline cable 401 may be run. The internal profile of cutter housing 102,202,302 may further comprise cutting mechanism seat 415 located distally to cable cutting mechanism 410 which may comprise a profiled surface about its distal portion.

Wireline cable cutting mechanism 410 may comprise any known cable cutting mechanism capable of cutting wireline cable 401 that is compression-activated or adapted to be activated based upon a predetermined force being applied to cutting mechanism 410. Examples of such cable cutting mechanisms may include, but not be limited to any suitable mechanism which may cut, part, or sever a line (generically herein, "cut"), including mechanical cutting mechanisms comprising wedge-knife or double-knife compression cutters, or non-mechanical cutting mechanisms comprising ballistic cutters or chemical cutters. While the embodiments that follow illustrate cutting mechanism 410 as being coupled to the outer housing system, it should be understood that in alternative embodiments not illustrated, line cutting mechanism 410 may be coupled to the internal mandrel system and may be caused to cut line 401 as a result of contacting one or more internal surfaces or profiles of the outer housing system.

In embodiments, wireline cable cutting mechanism may be of a form comprising cable cutter 412 disposed between opposing wedges 411,413. Cable cutter 412 may be biased by cutter body 414 toward a first position wherein a cutting surface of cable cutter 412 is not in contact with wireline cable 401. Upon having sufficient force applied to the distal surface of cutting mechanism 410 by cutter press 140,240,340, cable cutter 412 may be directed toward a second position as shown in FIGS. 3*a*, 6*a*, and 10*a* by axial movement of wedge 413 toward a proximal direction, thus cutting wireline cable 401.

Cutter press 140,240,340 may be formed having a generally flat proximal surface perpendicular to the longitudinal axis of cable-head cutter tool 100,200,300 and having an opening at its distal portion adapted for threaded connection to a proximal end of drive mandrel 142,242,342. A proximal portion of cutter press 140,240,340 may have an outer diameter smaller than the internal diameter of cutter housing 102,202,302, thus forming an annular gap between the proximal portion of cutter press 140,240,340 and cutter housing 102,202,302, and may be provided with an axially-centered aperture through which wireline cable 401 may be run. An outer diameter of the distal portion of cutter press 140,240,340 may be in slidable contact with the inner surface of cutter housing 102,202,302 and may further be formed having a proximal surface adapted for resting contact against the distal portion of cutting mechanism seat 415. One or more sealing elements 141,241,341 may be disposed within one or more inner recessed surfaces of the distal portion of cutter press 140,240,340, which may be positioned distally to the threaded connection between cutter press 140,240,340 and drive mandrel 142,242,342 when fully engaged.

Seal housing 103,203,303 may be formed having a reduced diameter proximal portion adapted for threaded connection to a distal portion of cutter housing 102,202,302 and a reduced diameter distal portion adapted for threaded connection to a proximal portion of drive housing 111,211,311. One or more loaded lip seals 104,204,304 and one or more sealing elements 105,205,305 may be disposed within one or more inner recessed surfaces of the proximal portion of seal housing 103,203,303 and in slidable contact with a proximal portion of drive mandrel 142,242,342. One or more sealing elements 106,206,306 may be disposed in one or more recessed outer surfaces of the proximal portion of seal housing 103,203,303, which may be positioned proximally to the threaded connection between seal housing 103,203,303 and cutter housing 102,202,302. Similarly, one or more sealing elements 110,210,310 may be disposed in one or more recessed outer surfaces of the distal portion of seal housing 103,203,303, which may be positioned distally (in the first embodiment) or proximally (in the second and third embodiments) to the threaded connection between seal housing 103,203,303 and drive housing 111,211,311. Seal housing 103,203,303 may be provided with one or more jam screws 107,207,307 and sealing discs 108,208,308 to allow for a fluid to be introduced into the first annular fluid chamber of cable-head cutter tool 100,200,300. Seal housing 103,203,303 may also be provided with one or more counter bores 109,209,309 for use with a spanner wrench.

Drive housing 111,211,311 may be formed having an internally threaded proximal portion adapted for threaded connection to the reduced diameter distal portion of seal housing 103,203,303, and an internally threaded distal portion adapted for threaded connection to a reduced diameter proximal portion of filling sub 112,212,312. Drive housing 111,211,311 may be formed having an inner cross-sectional profile comprising one or more flat surfaces. For example, drive housing 111,211,311 may be formed having a hexagonal inner cross-sectional profile.

Drive mandrel 142,242,342 may be formed having a proximal portion adapted for threaded connection to cutter press 140,240,340, an enlarged distal portion adapted to threadably receive a proximal portion of release mandrel 144,244,344, and an axially centered channel through which wireline cable 401 may be run. Drive mandrel 142,242,342 may be formed having a diameter about a central portion of its length which may allow drive mandrel 142,242,342 to remain in slidable contact with a proximal inner diameter of seal housing 103,203,303. One or more sealing elements 143,243,343 may be disposed within one or more inner recessed surfaces of the distal portion of drive mandrel 142,242,342, which may be positioned proximally to the threaded connection between drive mandrel 142,242,342 and release mandrel 144,244,344. The enlarged distal portion of drive mandrel 142,242,342 may be formed having an outer cross-sectional profile comprising one or more flat surfaces which may remain in slidable contact with the one or more flat inner surfaces of drive housing 111,211,311. For example, the enlarged distal portion of drive mandrel 142,242,342 may be formed having a hexagonal outer cross-sectional profile. Each of the one or more flat surfaces of the distal portion of drive mandrel 142,242,342 may further comprise one or more recessed longitudinal channels allowing fluid communication between a proximal surface of the distal portion of drive mandrel 142,242,342 to a distal surface of the distal portion of drive mandrel 142,242,342 and vice-versa.

Filling sub 112,212,312 may be formed having a reduced diameter proximal portion adapted for threaded connection to a distal portion of drive housing 111,211,311 and a reduced diameter distal portion adapted for threaded connection to a proximal portion of release housing 117,218,318. One or more sealing elements 113,213,313 may be disposed in one or more recessed outer surfaces of the proximal portion of filling sub 112,212,312, which may be positioned distally to the threaded connection between filling sub 112,212,312 and drive housing 111,211,311. Similarly, one or more sealing elements 116,217,317 may be disposed in one or more recessed outer surfaces of the distal portion of filling sub 112,212,312 which may be positioned distally to the threaded connection between filling sub 112,212,312 and release housing 117,218,318. Filling sub 112,212,312 may be provided with one or more jam screws 114,214,314 and sealing discs 115,215,315 to allow for a fluid to be introduced into the first annular fluid chamber of cable-head cutter tool 100,200,300. Filling sub 112,212,312 may also be provided with one or more counter bores 112*a*,216,316 for use with a spanner wrench. Additionally, filling sub 112,212,312 may be provided with a recessed proximal surface.

Release housing 117,218,318 may be formed having an internally threaded proximal portion adapted for threaded connection to the reduced diameter distal portion of filling sub 112,212,312, and an internally threaded distal portion adapted for threaded connection to adjustment mandrel 118,219 (in the first and second embodiments) or release sub 319 (in the third embodiment). Release housing 117,218,318 may be formed having housing shoulders 171*a*,218*a*,318*a* (proximal) and 171*b*,218*b*,318*b* (distal) about a middle portion of release housing 117,218,318. In the third embodiment, the housing of cable-head cutter tool 300 may comprise release sub 319, which may be formed having a reduced diameter proximal portion adapted for threaded connection to a distal portion of release housing 318, and a reduced diameter distal portion adapted for threaded connection to a proximal portion of pressure housing 323. One or more sealing elements 320 may be disposed in one or more recessed outer surfaces of the proximal portion of release sub 319, which may be positioned proximally to the threaded connection between release sub 319 and release housing 318. Similarly, one or more sealing elements 322 may be disposed in one or more recessed outer surfaces of the distal portion of release sub 319, which may be positioned distally to the threaded connection between release sub 319 and pressure housing 323. Release sub 319 may be provided with one or more counter bores 321 for use with a spanner wrench. Also in the third embodiment, the housing of cable-head cutter tool 300 may comprise pressure housing 323, which may be formed having an internally threaded proximal portion adapted for threaded connection to the reduced diameter distal portion of release sub 319, and an internally threaded distal portion adapted for threaded connection to adjustment mandrel 324. Pressure housing 323 may be formed having housing shoulders 323*a* (proximal) and 323*b* (distal) about a middle portion of pressure housing 323.

Release mandrel 144,244,344 may be formed having a proximal portion adapted for threaded connection to the enlarged diameter distal portion of drive mandrel 142,242,342, a reduced diameter distal portion adapted for threaded connection to an enlarged proximal portion of connector mandrel 146,246,346, and an axially centered channel through which wireline cable 401 may be run. Additional details of release mandrel 144,244,344 will be presented in detail for each embodiment of cable-head cutter tool 100,200,300 separately.

Adjustment housing 122,223,329 may be formed having an internally threaded proximal portion adapted for threaded connection to a reduced-diameter distal portion of adjustment mandrel 118,219,324 wherein adjustment mandrel 118,219,324 may further comprise a proximal portion adapted for threaded connection to an internally threaded distal portion of release housing 117,218 (in the first and second embodiments) or pressure housing 323 (in the third embodiment). A proximal surface of adjustment mandrel 118,219,324 may be formed having a shoulder, seat, or recess adapted to receive a distal portion of biasing element 186,287,396 and may further comprise a recessed radial profile adapted to receive a distal lip of split ring retainer 185,286,395. Adjustment housing 122,223,329 may further be formed having a reduced diameter distal portion adapted for threaded connection to a proximal portion of balance housing 126,226,332. One or more sealing elements 119,220,325 may be disposed in one or more recessed outer surfaces of the proximal portion of adjustment mandrel 118,219,324, which may be positioned proximally to the threaded connection between adjustment mandrel 118,219,324 and release housing 117,218 (in the first and second embodiments) or pressure housing 323 (in the third embodiment). Similarly, one or more sealing elements 123,224,328 may be disposed in one or more recessed outer surfaces of the distal portion of adjustment mandrel 118,219,324, which may be positioned distally to the threaded connection between adjustment mandrel 118,219,324 and adjustment housing 122,223,329. Additionally, one or more sealing elements 125,225,331 may be disposed in one or more recessed outer surfaces of the distal portion of adjustment housing 122,223,329, which may be positioned distally to the threaded connection between adjustment housing 122, 223,329 and balance housing 126,226,332. Adjustment ring 120,221,326 may surround adjustment mandrel 118,219,324 and may be provided with one or more adjustment keys 121,222,327 which allow rotating the adjustment mandrel to vary the position of trigger sleeve 184,285,394 in relation to release mechanism, dog clutch, load release latch, or collet 181,282,391. Adjustment housing 122,329 may be provided with one or more counter bores 124,223*a*,330 for use with a spanner wrench.

Connector mandrel 146,246,346 may be formed having an enlarged diameter proximal portion adapted to threadably receive a distal portion of release mandrel 144,244,344, an enlarged diameter distal portion adapted to threadably receive a proximal portion of balance mandrel 148,248,348, and an axially centered channel through which wireline cable 401 may be run. One or more sealing elements 145,245,345 may be disposed within one or more inner recessed surfaces of the proximal portion of connector mandrel 146,246,346, which may be positioned distally to the threaded connection between release mandrel 144,244, 344 and connector mandrel 146,246,346. Similarly, one or more sealing elements 147,247,347 may be disposed within one or more inner recessed surfaces of the distal portion of connector mandrel 146,246,346, which may be positioned proximally to the threaded connection between connector mandrel 146,246,346 and balance mandrel 148,248,348.

Balance housing 126,226,332 may be formed having an internally threaded proximal portion adapted for threaded connection to the reduced diameter distal portion of adjustment housing 122,223,329, and an internally threaded distal portion adapted for threaded connection to a reduced diameter proximal portion of floater sub 128,228,334. Balance housing 126,226,332 may be provided with one or more mud ports 127,227,333 positioned generally distally with respect to balance housing 126,226,332 and proximally to a proximal surface of floater sub 128,228,334. Each of the one or more mud ports 127,227,333 may allow a wellbore fluid to communicate with a second annular fluid chamber formed by an annular cavity between balance housing 126,226,332 and balance mandrel 148,248,348, located distally relative to balancing piston 150,250,350.

Balance mandrel 148,248,348 may be formed having a reduced diameter proximal portion adapted for threaded connection to the distal portion of connecter mandrel 146, 246,346, an axially centered channel through which wireline cable 401 may be run, and a distal portion adapted to a desired terminating connection 420.

Balancing piston 150,250,350 may be formed having an inner diameter allowing balancing piston 150,250,350 to remain in slidable contact with balance mandrel 148,248, 348, and an outer diameter allowing balancing piston 150, 250,350 to remain in slidable contact with balance housing 126,226,332. One or more loaded lip seals 151,251,351 and one or more sealing elements 152,252,352 may be disposed in one or more recessed outer surfaces of balancing piston 150,250,350. Similarly, one or more loaded lip seals 153, 253,353 and one or more sealing elements 154,254,354 may be disposed in one or more recessed inner surfaces of balancing piston 150,250,350. Balancing piston 150,250, 350 acts to balance pressure differentials between the first and second annular fluid chambers which may result from variances in temperature and/or hydrostatic pressure at different well depths. The details and operation of the balancing piston are described in applicant's U.S. Pat. No. 7,290, 604, the entire content of which is incorporated herein by reference thereto.

Floater sub 128,228,334 may be formed having a reduced diameter proximal portion adapted for threaded connection to a distal portion of balance housing 126,226,332, and a reduced diameter distal portion adapted for threaded connection to a proximal portion of connection housing 132, 232,338. One or more sealing elements 129,229,335 may be disposed in one or more recessed outer surfaces of the proximal portion of floater sub 128,228,334, which may be positioned proximally to the threaded connection between floater sub 128,228,334 and balance housing 126,226,332. Similarly, one or more sealing elements 131,231,337 may be disposed in one or more recessed outer surfaces of the distal portion of floater sub 128,228,334 which may be positioned distally to the threaded connection between floater sub 128,228,334 and connection housing 132,232,338.

Connection housing 132,232,338 may be formed having an internally threaded proximal portion adapted for threaded connection to the reduced diameter distal portion of floater sub 128,228,334 and an internally-threaded distal portion adapted for threaded connection to a reduced diameter proximal portion of lower connection housing 441.

Wireline cable termination 420 may comprise any known wireline cable termination. Examples of such cable termination may include, but not be limited to cones-and-basket, rope socket, or turned-back cable termination methods. In embodiments, wireline cable termination 420 may comprise a rope socket—type termination, wherein wireline cable termination 420 may comprise rope socket body 421, outer cone 422, inner cone 423, and locking nut 424.

Wireline cable terminating connection 430 may comprise any known cable conductor termination connection. Examples of such cable conductor termination connections may include, but not be limited to socket and booth connections or tear drop connections. In embodiments, wireline cable terminating connection 430 may comprise slack wireline conductor 431, crimped and/or soldered connection 432, and electrical contact 433, with soldered connection 432 and electrical contact 433 surrounded by rubber boot 434.

Wireline cable lower connection 440 may comprise any known wireline cable lower connection. Examples of such cable lower connections may include, but not be limited to feedthrough pressure terminal and plunger contact, feedthrough pressure terminal and pin or socket contact, feedthrough isolated rod and plunger contact, or feedthrough isolated rod and pin or socket contact. In embodiments, wireline cable lower connection 440 may comprise lower connection housing 441, electrical feedthrough 443, one or more insulators 444, contact nut 445, coil spring 446, retaining ring 447 (not shown), and contact plunger 448. Lower connection housing 441 may be formed having a reduced diameter proximal portion adapted for threaded connection to a distal portion of connection housing 132, 232,338. One or more sealing elements 442 may be disposed in one or more recessed outer surfaces of the proximal portion of lower connection housing 441, which may be positioned proximally to the threaded connection between lower connection housing 441 and connection housing 132, 232,338. Lower connection housing 441 may be formed to allow additional equipment to be connected to a distal portion of lower connection housing 441 which together with cable-head cutter tool 100,200,300 may comprise a tool string attached to wireline cable 401.

In embodiments, each of the one or more sealing elements 105,205,305, 106,206,306, 110,210,310, 113,213,313, 116,

217,317, 320, 322, 119,220,325, 123,224,328, 125,225,331, 129,229,335, 131,231,337, 141,241,341, 143,243,343, 145, 245,345, 147,247,347, 152,252,352, 154,254,354, and 442 may be any suitable sealing element, for example an O-ring, and may be formed from any suitable material, for example nitrile (buna-N), ethylene propylene rubber (EPR), fluorocarbon (viton), neoprene, or polyurethane.

Embodiment-Specific Aspects

In the first embodiment, drive housing 111 surrounds drive mandrel 142, providing an annular cavity in which biasing element 160 and pressure piston assembly 161 may be located. Drive mandrel 142 may be formed having an overall length which allows cutter press 140 to be positioned away from a proximal surface of seal housing 103 while the distal surface of drive mandrel 142 is in resting contact with a proximal surface of filling sub 112. Biasing element 160 may be any suitable biasing element, for example a coiled spring. A proximal portion of biasing element 160 may be in contact with a distal surface of seal housing 103, and a distal portion of biasing element 160 may be in contact with a proximal surface of pressure piston assembly 161. Biasing element 160 may be axially compressed and configured to bias pressure piston 161 in the distal direction.

In the second and third embodiments, drive mandrel 242,342 may be formed having an overall length which allows cutter press 240,340 to be positioned away from a proximal surface of seal housing 203,303 while the distal surface of drive mandrel 242,342 is in resting contact with the recessed proximal surface of filling sub 212,312. Biasing element 260,360 may be disposed within an annular cavity formed between filling sub 212,312 and release mandrel 244,344 and surrounding a proximal portion of release mandrel 244,344. Biasing element 260,360 may be any suitable biasing element, for example a coil spring, and may be referred to as a "recocking spring". A proximal portion of biasing element 260,360 may be in contact with an internal shoulder formed within a proximal portion of filling sub 212,312, while a distal portion of biasing element 260,360 may be in contact with a shoulder formed on the surface of a proximal portion of release mandrel 244,344. In this manner, biasing element 260,360 is configured to bias release mandrel 244,344 in the distal direction.

In the first embodiment, release housing 117 surrounds release mandrel 144, providing an annular cavity in which biasing element 168, compression ring 170, and triggering mechanism 180 may be located. Release mandrel 144 may be formed having an overall length which allows the distal end of release mandrel 144 to be positioned about centrally within adjustment mandrel 118 when the distal surface of drive mandrel 142 is in resting contact with the proximal surface of filling sub 112, and an outer diameter about a central portion of its length which may allow release mandrel 144 to be in slidable contact with an inner diameter of compression ring 170. A proximal portion of biasing element 168 may be in contact with a distal surface of filling sub 112, while a distal portion of biasing element 168 may be in contact with a proximal surface of compression ring 170. Biasing element 168 may be configured to bias compression ring 170 in the distal direction.

In the second embodiment, release housing 218 surrounds release mandrel 244, providing an annular cavity in which biasing element 261, pressure piston 263, and triggering mechanism 280 may be located. Release mandrel 244 may be formed having an overall length which allows the distal end of release mandrel 244 to be positioned about centrally within adjustment mandrel 219 when the distal surface of drive mandrel 242 is in resting contact with the recessed proximal surface of filling sub 212. Release mandrel 244 may be formed having an outer diameter about a central portion of its length which may allow release mandrel 244 to be in slidable contact with an inner surface of pressure piston 263. A proximal portion of biasing element 261 may be in contact with a distal surface of filling sub 212, while a distal portion of biasing element 261 may be in contact with a proximal surface of pressure piston 263. In this manner, biasing element 261 is configured to bias pressure piston 263 in the distal direction.

In the third embodiment, release housing 318 surrounds release mandrel 344, providing an annular cavity in which biasing element 361, pressure piston 363, and second triggering mechanism 380 may be located. Release mandrel 344 may be formed having an overall length which allows the distal end of release mandrel 344 to be positioned about centrally within adjustment mandrel 324 when the distal surface of drive mandrel 342 is in resting contact with the recessed proximal surface of filling sub 312. Release mandrel 344 may be formed having an outer diameter about a central portion of its length which may allow release mandrel 344 to be in slidable contact with an inner surface of pressure piston 363 and an inner diameter of compression ring 371. Pressure housing 323 also surrounds a release mandrel 344, providing an annular cavity in which biasing element 369, compression ring 371, and first triggering mechanism 390 may be located. A proximal portion of biasing element 361 may be in contact with a distal surface of filling sub 312, while a distal portion of biasing element 361 may be in contact with a proximal surface of pressure piston 363. In this manner, biasing element 361 is configured to bias pressure piston 363 in the distal direction. Similarly, a proximal portion of biasing element 369 may be in contact with a distal surface of release sub 319, while a distal portion of biasing element 369 may be in contact with a proximal surface of compression ring 371. In this manner, biasing element 369 is configured to bias compression ring 371 in the distal direction.

Biasing element 168,261,361,369 may be any suitable biasing element. For example, biasing element 168,261,361, 369 may be a Belleville spring stack. One or more biasing element guides 169,262,362,370 may be disposed between biasing element 168,261,361,369 and release mandrel 144, 244,344 and may be any suitable biasing element guide. For example, biasing element guide 169,262,362,370 may be a Belleville spring guide similar to that described in applicant's U.S. Pat. No. 7,854,425, the entire content of which is incorporated herein by reference thereto. Biasing element 168,261,361,369 may be axially compressed and configured to bias compression ring 170, pressure piston 263,363, or compression ring 371, respectively, in the distal direction.

Pressure piston assembly 161,263,363 may allow fluid communication from a proximal surface of pressure piston assembly 161,263,363 to a distal surface of pressure piston assembly 161,263,363 and vice-versa and may comprise one or more metering orifices 162,264,364 and at least one check valve 164,265,365 having at least one filter 165,266,366. An inner surface of pressure piston assembly 161,263,363 may comprise one or more inner sealing elements 166,267,367 and remain in slidable contact with drive mandrel 142 (in the first embodiment) or release mandrel 244,344 (in the second and third embodiments) while an outer surface of pressure piston assembly 161,263,363 may comprise one or more outer sealing elements 167,268,368 and may remain in slidable contact with drive housing 111 (in the first embodiment) or release housing 218,318 (in the second and third embodiments). Pressure piston assembly 161,263,363 divides the first annular fluid chamber of cable-head cutter tool 100,200,300 into a proximal portion extending from the distal portion of seal housing 103,203,303 to the proximal surface of pressure piston 161,263,363 and a distal portion extending from the distal surface of pressure piston 161, 263,363 to the proximal surface of balancing piston 150, 250,350. In operation, pressure piston assembly 161,263, 363 acts to provide a time-delay as the drive mandrel of cable-head cutter tool 100,200,300 is moved in a proximal direction.

Compression ring 170,371 may be formed having an outer diameter allowing compression ring 170,371 to remain in slidable contact with the inner surface of a release housing 117 (in the first embodiment) or pressure housing 323 (in the third embodiment) which is proximal to internal shoulder 117*a*,323*a* and an internal diameter allowing compression ring 170,371 to be in slidable contact with release mandrel 144,344. Compression ring 170,371 may comprise one or more fluid passages allowing fluid communication between any of a proximal surface, a distal surface, an outer surface, an inner surface, or combinations thereof of compression ring 170,371. Biasing element 168,369 may bias compression ring 170,371 to be in contact with internal shoulder 171*a*,323*a*.

Triggering mechanism 180,280,380,390 may be similar to that described by applicant's U.S. Pat. No. 9,428,980, the entire content of which is incorporated herein by reference thereto. Triggering mechanism 180,280,380,390 may comprise a release mechanism, dog clutch, load release latch, or collet 181,282,382,391, one or more garter springs 182,283, 383,392, guide ring 183,284,384,393, trigger sleeve 184, 285,385,394, split ring retainer 185,286,395, and biasing element 186,287,386,396. In the second and third embodiments, triggering mechanism 280,380 may further comprise compression ring 281,381.

Release mechanism, dog clutch, load release latch, or collet 181,282,382,391 may be similar to that described by applicant's U.S. Pat. No. 10,669,800, the entire content of which is incorporated herein by reference thereto. Release mechanism, dog clutch, load release latch, or collet 181, 282,382,391 may comprise a plurality of release lugs which may include a plurality of projections of varying width on an inner surface adapted to engage a corresponding plurality of recessed grooves on an outer surface of release mandrel 144,244,344, and a plurality of grooves on an outer surface which may be adapted to receive a corresponding plurality of projections on an inner surface of trigger sleeve 184,285, 385,394. Each of the plurality of release lugs comprising release mechanism, dog clutch, load release latch, or collet 181,282,382,391 may be radially separated by an axial space and may be provided with a plurality of smaller grooves on an outer surface which may be adapted to hold garter springs 182,283,383,392. Garter springs 182,283,383,392 may circumferentially surround the plurality of release lugs, allowing for radial expansion and contraction of release mechanism, dog clutch, load release latch, or collet 181,282,382, 391. A recessed inner profile of each of the plurality of release lugs comprising release mechanism, dog clutch, load release latch, or collet 181,282,382,391 may be adapted to surround guide ring 183,284,384,393, holding them in axial alignment while traveling along an outer surface of release mandrel 144,244,344.

Trigger sleeve 184,285,385,394 may be generally tubular, and may be radially positioned between release housing 117,218,318 or pressure housing 323, and release mechanism, dog clutch, load release latch, or collet 181,282,382, 391, respectively. Trigger sleeve 184,285,385,394 may be axially positioned between shoulder 117*b*,218*b*,318*b*,323*b* and a proximal surface of adjustment mandrel 118,219, release sub 319, or adjustment mandrel 324, respectively. Trigger sleeve 184,285,385,394 slidably engages release housing 117,218,318 or pressure housing 323, respectively, and thus is generally free to move axially between shoulder 117*b*,218*b*,318*b*,323*b* and a proximal surface of adjustment mandrel 118,219, release sub 319, or adjustment mandrel 324, respectively as allowed by biasing element 186,287, 386,396. Trigger sleeve 184,285,385,394 may have a radially outer cylindrical surface that slidingly engages release housing 117,218,318 or pressure housing 323, respectively, and a radially inner surface that includes a plurality of annular recesses defining a plurality of radially inwardly projecting annular flanges. Each of the plurality of flanges may be axially disposed between each of the plurality of adjacent recesses. As will be described in more detail below, each of the plurality of recesses and flanges may be sized and configured to releasably engage a plurality of mating flanges and recesses, respectively, provided on the radially outer surface of release mechanism, dog clutch, load release latch, or collet 181,282,382,391.

Split ring retainer 185,286,395 may be generally tubular, and may be formed having an outer diameter which may allow split ring retainer 185,286,395 to be in contact with an internal surface of release housing 117,218 or pressure housing 323, respectively. Split ring retainer 185,286,395 may comprise a proximal lip which is adapted to be received by a recessed radial profile of trigger sleeve 184,285,394 and a distal lip which is adapted to be received by a recessed radial profile of adjustment mandrel 118,219,324.

Biasing element 186,287,386,396 may be any suitable biasing element, for example a coiled spring. A proximal portion of biasing element 186,287,386,396 may be in contact with, seated, or adapted to be received by a distal shoulder, seat, or recess of trigger sleeve 184,285,385,394, and a distal portion of biasing element 186,287,386,396 may be in contact with, seated, or adapted to be received by a proximal shoulder, seat, or recess of adjustment mandrel 118,219, release sub 319, or adjustment mandrel 324, respectively. Biasing element 186,287,386,396 may be axially compressed and configured to bias trigger sleeve 184, 285,385,394 into engagement with shoulder 117*b*,218*b*, 318*b*,323*b*.

In the second and third embodiments, compression ring 281,381 may surround release mandrel 244,344, with an inner surface of compression ring 281,381 remaining in slidable contact with an outer surface of release mandrel 244,344. A distal surface of compression ring 281,381 may contact a proximal surface of release mechanism 282,382, and a proximal surface of compression ring 281,381 may be available to contact a distal surface of pressure piston 263,363.

The outer radial diameters of release mechanism, dog clutch, load release latch, or collet 181,282,382,391 and compression ring 281,381 may be sized to allow release mechanism, dog clutch, load release latch, or collet 181, 282,382,391 and compression ring 281,381 to slidably pass shoulders 117*a*,218*a*,318*a*,323*a* and 117*b*,218*b*,318*b*,323*b* while allowing fluid communication between the proximal and distal portions, respectively thereto, of the first annular fluid chamber of cable-head cutter tool 100,200,300.

Functional Aspects and Operation

Each embodiment of cable-head cutter tool 100,200,300 described herein may be provided with componentry which may exhibit similar functional aspects across each embodiment, yet different combinations of such componentry provided within each embodiment of cable-head cutter tool 100,200,300 may result in differing aggregate functional aspects, behaviors, features, and benefits specific to each embodiment. Examples of such componentry may include mandrel system 149,249,349, biasing element 168,261,361,369, pressure piston assembly 161,263,363, adjustment mandrel 118,219,324, triggering mechanism 180,280,380,390, and reset biasing element 160,260,360. The individual functional aspects of such componentry may be the same or similar to those described by U.S. Pat. Nos. 10,202,815, 9,428,980, 8,443,902, and 7,510,008, the entire contents of which are incorporated herein by reference thereto.

For simplicity of reference, mandrel system 149,249,349 of cable-head cutter tool 100,200,300 may comprise individual mandrel components 140,142,144,146,148, individual mandrel components 240,242,244,246,248, or individual mandrel components 340,342,344,346,348, respectively. In operation, an increase in a tensile load applied to wireline cable 401 may be transferred to mandrel system 149,249,349 via wireline cable termination 420, which may result in mandrel system 149,249,349 becoming biased toward a proximal direction. Similarly, a relaxation of a tensile load applied to wireline cable 401 may be transferred to mandrel system 149,249,349 via wireline cable termination 420, which may result in a reduction of mandrel system 149,249,349 being biased toward a proximal direction. Slack wireline conductor 431 may provide sufficient slack within connection housing 132,232,338 to allow mandrel system 149,249,349 to travel a longitudinal distance in a proximal direction which may allow cutter press 140,240,340 to be fully seated against cutting mechanism seat 415 without applying tension to a portion of wireline cable 401 located distally relative to wireline cable termination 420.

When traveling longitudinally in a proximal direction, the movement of mandrel system 149,249,349 may be registered against and resisted by biasing element 168,261,361,369. Once registered, mandrel system 149,249,349 may not begin to travel further until a tensile load applied to wireline cable 401 exceeds a preload force provided by biasing elements 168,261,361,369. Axial compression of biasing member 168,261,361,369 resulting from continued travel of mandrel system 149,249,349 may generate an increasing spring force that may increasingly resist continued axial movement of mandrel system 149,249,349.

As previously described, pressure piston assembly 161,263,363 divides the first annular fluid chamber of cable-head cutter tool 100,200,300 into a proximal portion and a distal portion. As longitudinal travel of mandrel system 149,249,349 is registered against a distal surface of pressure piston assembly 161,263,363, pressure piston assembly 161,263,363 may begin to travel together with mandrel system 149,249,349. A working fluid occupying the first annular fluid chamber may further resist movement of mandrel system 149,249,349 in a proximal direction as the volume of the proximal portion of the first annular fluid chamber is reduced, thus causing a significant increase in the working fluid pressure within the proximal portion of the first annular fluid chamber.

The hydraulic resistance provided by pressure piston assembly 161,263,363 and the mechanical resistance provided by biasing element 168,261,361,369 may thus allow a large buildup of potential energy in the working string of cable-head cutter tool 100,200,300. Over time, metering orifice 162,264,364 may allow working fluid to flow through pressure piston assembly 161,263,363, thereby slowly relieving the pressure in the proximal portion of the first annular fluid chamber of cable-head cutter tool 100,200,300. It is this bleeding of working fluid across pressure piston assembly 161,263,363 which defines a hydraulic time-delay portion of a firing cycle of cable-head cutter tool 100,200,300. If a tensile load applied to wireline cable 401 is maintained at a level sufficient to overcome the preload force provided by biasing element 168,261,361,369 and the increasing spring force resulting from axial compression of biasing element 168,261,361,369, mandrel system 149,249,349 may continue to move longitudinally in a proximal direction.

Adjustment mandrel 118,219,324 may be threadably received at a proximal portion by release housing 117,218 (in the first and second embodiments) or pressure housing 323 (in the third embodiment), and may be threadably received at a distal portion by adjustment housing 122,223,329. The proximal and distal threads of adjustment mandrel 118,219,324 may be oppositely threaded, such that rotation of adjustment mandrel 118,219,324 about its longitudinal axis may result in axial translation of adjustment mandrel 118,219,324 relative to release housing 117,218 (in the first and second embodiments) or pressure housing 323 (in the third embodiment). This axial translation may thus vary the position of trigger sleeve 184,285,394 in relation to release mechanism, dog clutch, load release latch, or collet 181,282,391, which may thereby adjust the amount of axial travel of mandrel system 149,249,349 required before allowing triggering mechanism 180,280,390 to become triggered.

Triggering mechanism 180,280,380,390 may serve to regulate communication between mandrel system 149,249,349 and biasing element 168,261,361,369. In an initial, closed, or run-in, configuration, an internal profile of release mechanism, dog clutch, load release latch, or collet 181,282,382,391 may engage a complimentary external profile of release mandrel 144,244,344, which may result from garter springs 182,283,383,392 causing release mechanism, dog clutch, load release latch, or collet 181,282,382,391 to close around the complimentary external profile of release mandrel 144,244,344. As mandrel system 149,249,349 travels in a proximal direction, an external profile of release mechanism, dog clutch, load release latch, or collet 181,282,382,391 may come into alignment with a complimentary internal profile of trigger sleeve 184,285,385,394, which may allow release mechanism, dog clutch, load release latch, or collet 181,282,382,391 to expand radially to a second, or open, configuration. In this manner, release mechanism, dog clutch, load release latch, or collet 181,282,382,391 becoming fully registered against trigger sleeve 184,285,385,394 may provide sufficient clearance between the complimentary surfaces of the internal profile of release mechanism, dog clutch, load release latch, or collet 181,282,382,391 and the external profile of release mandrel 144,244,344 so as to allow mandrel system 149,249,349 to travel without engaging release mechanism, dog clutch, load release latch, or collet 181,282,382,391, and thus not communicate its travel to biasing element 168,261,361,369.

Reversing the steps just described, when release mechanism, dog clutch, load release latch, or collet 181,282,382,391 may be fully registered against trigger sleeve 184,285,385,394, mandrel system 149,249,349 may travel in a distal direction free from engagement with release mechanism, dog clutch, load release latch, or collet 181,282,382,391. As the external profile of release mandrel 144,244,344 comes into alignment with the complimentary internal profile of release mechanism, dog clutch, load release latch, or collet 181,282,382,391, release mechanism, dog clutch, load release latch, or collet 181,282,382,391 may return to the initial, closed, or run-in, configuration fully engaging release mandrel 144,244,344, which may result from garter springs 182,283,383,392 causing release mechanism, dog clutch, load release latch, or collet 181,282,382,391 to close around the complimentary external profile of release mandrel 144, 244,344. In this manner, release mechanism, dog clutch, load release latch, or collet 181,282,382,391 becoming fully registered against release mandrel 144,244,344, may provide sufficient clearance between the complimentary surfaces of the external profile of release mechanism, dog clutch, load release latch, or collet 181,282,382,391 and the internal profile of trigger sleeve 184,285,385,394 so as to allow mandrel system 149,249,349 to travel in engagement with release mechanism, dog clutch, load release latch, or collet 181,282,382,391 in a distal direction without engaging trigger sleeve 184,285,385,394.

Reset biasing element 160,260,360 may bias mandrel system 149,249,349 to travel in a distal direction. In this manner, relaxing a tensile load applied to wireline cable 401 may allow reset biasing element 160,260,360 to bias cable-head cutter tool 100,200,300 to return to its initial configuration.

Prior to deploying cable-head cutter tool 100,200,300, an operator may determine one or more forces which may act upon or be imposed upon cable-head cutter tool 100,200,300 when deployed in a well. These may include, but not be limited to, the weight of the tool string including cable-head cutter tool 100,200,300 which will be supported by wireline cable 401, any buoyancy forces which may act upon the tool string and which may vary based upon a depth of the tool string relative to a column of fluid present in the well, a maximum tension which may be applied to wireline cable 401 to maintain a desired level of safety, a desired tensile load which may be applied to wireline cable 401 in order to activate wireline cable cutting mechanism 410, or a desired amount of time required to pass after applying the tensile load required to activate wireline cable cutting mechanism 410, or combinations thereof. The operator may determine these forces through a process of modeling, which may take into account one or more additional factors which may be present in or act upon the well, for example geological, environmental, temperature, pressure, or other such factors. The operator may then set cable-head cutter tool 100,200, 300 to a desired configuration based upon the modeling by adjusting the tensile load required to be applied to wireline cable 401 in order to activate the wireline cable cutting mechanism 410, which may be done by adjusting the configuration of adjustment mandrel 118,249,324. Prior to deploying cable-head cutter tool 100,200,300, the operator may add a restraining element such as an O-ring, sticky tape, glue, or other adhesive forms to wireline cable 401 at a location proximal to where wireline cutting mechanism 410 may cut the wireline cable 401.

Once set to the operator's desired configuration, the operator may deploy the tool string comprising cable-head cutter tool 100,200,300 into the well by lowering the tool string from the surface using wireline cable 401 to control its descent. In a complimentary manner, the operator may retrieve the tool string comprising cable-head cutter tool 100,200,300 from the well by applying or adjusting a lifting force to wireline cable 401 to control its ascent. During ascent, the tool string comprising wireline cable cutter tool 100,200,300 may become stuck in the well, which may result in an increased tensile load being applied to wireline cable 401, which in turn may cause mandrel system 149, 249,349 to become biased in a proximal direction relative to the housing system of cable-head cutter tool 100,200,300 in the manner described. If the tool string becomes stuck in the well, the operator may proceed to increase, decrease, or hold steady the tensile load applied to wireline cable 401, or may proceed to adjust the tensile load applied to wireline cable 401 over a length of time through combinations of increasing, decreasing, or holding steady the tensile load applied to wireline cable 401. In this manner, mandrel system 149,249, 349 may closely follow changes in tension applied to wireline cable 401, and may be caused to travel in relation to the housing system of cable-head cutter tool 100,200,300.

Increasing the tensile load applied to wireline cable 401 may cause an increase in the potential energy built-up through the hydraulic resistance provided by pressure piston assembly 161,263,363 and the mechanical resistance provided by biasing element 168,261,361,369 as mandrel system 149,249,349 travels in a proximal direction. Holding steady the tensile load applied to wireline cable 401 may result in a decrease of this potential energy as pressure from the proximal portion of the first annular fluid chamber is relieved through pressure piston assembly 161,263,363 to the distal portion. Decreasing the tensile load applied to wireline cable 401 may cause a decrease in this potential energy based on relaxing the compressive force applied to biasing element 168,261,361,369, and may result in cable-head cutter tool 100,200,300 returning to its run-in configuration as a result of reset biasing element 160,260,360 biasing mandrel system 149,249,349 in a distal direction.

Cable-head cutter tool 100,200,300 may cut wireline cable 401 if the tensile load applied to wireline cable 401 is sufficient enough to cause mandrel system 149,249,349 to travel in a proximal direction such that triggering mechanism 180,280,380,390 are caused to release mandrel system 149,249,349 as a result of the tensile load applied to wireline cable 401 overcoming the mechanical resistance of biasing elements 168,261,361,369. Upon causing wireline cable cutting mechanism 410 to cut wireline cable 401, the operator may retrieve the now cut wireline cable 401 from the well and proceed to recover the tool string comprising cable-head cutter tool 100,200,300 from the well using an appropriate means which may rely upon engagement of fishing neck 101,201,301. Each embodiment of cable-head cutter tool 100,200,300 may vary in the method though which wireline cable 401 may be cut.

In the first embodiment, as cable-head cutter tool 100 begins to undertake a progressive sequence toward causing wireline cable cutting mechanism 410 to cut wireline cable 401, initial travel of mandrel system 149 in a proximal direction may cause a proximal surface of release mechanism, dog clutch, load release latch, or collet 181 to engage a distal surface of compression ring 170. Continued travel of mandrel system 149 in a proximal direction may next cause biasing element 168 to become increasingly compressed, and thus increasingly resist continued travel of mandrel system 149. If the tensile load applied to wireline cable 401 is sufficient to overcome the increasing resistance of biasing element 168, release mechanism, dog clutch, load release latch, or collet 181 may come into alignment with and expand to register against trigger sleeve 184 and thus free mandrel system 149 to travel unrestrained in a proximal direction until a proximal shoulder formed by the enlarged distal portion of drive mandrel 142 may engage a distal surface of pressure piston assembly 161. As mandrel system 149 continues to travel in a proximal direction, pressure piston assembly 161 may cause biasing element 160 to become increasingly compressed as working fluid passes through pressure piston assembly 161 from the proximal portion to the distal portion of the first annular fluid chamber. If the tensile load applied to wireline cable 401 is sufficient to overcome the increasing resistance provided by biasing element 160, continued forward travel of mandrel system 149 may cause a proximal surface of cutter press 140 to engage a distal surface of wireline cable cutting mechanism 410, thereby actuating wireline cable cutting mechanism 410 and thus cutting wireline cable 401. Relaxation of the tensile load applied to wireline cable 401 prior to actuation of wireline cable cutting mechanism 410 may cause this progressive sequence to be reversed from the point at which the tensile load is reduced. In operation, cable-head cutter tool 100 may provide an operator with an ability to gradually progress toward cutting wireline cable 401 through an increase in tensile load applied to wireline cable 401.

In the second embodiment, as cable-head cutter tool 200 begins to undertake a progressive sequence toward causing wireline cable cutting mechanism 410 to cut wireline cable 401, initial travel of mandrel system 249 in a proximal direction may cause biasing element 261 to immediately begin to compress due to a proximal surface of release mechanism, dog clutch, load release latch, or collet 282 acting against compression ring 281, which in turn acts against pressure piston assembly 263, which in turn acts against biasing element 261. Continued travel of mandrel system 249 in a proximal direction may next cause biasing element 261 to become increasingly compressed, and thus increasingly resist continued travel of mandrel system 249 as working fluid passes through pressure piston assembly 263 from the proximal portion to the distal portion of the first annular fluid chamber. If the tensile load applied to wireline cable 401 is sufficient to overcome the increasing resistance of biasing element 261, release mechanism, dog clutch, load release latch, or collet 282 may come into alignment with and expand to register against trigger sleeve 285 and thus free mandrel system 249 to travel unrestrained in a proximal direction until a proximal surface of cutter press 240 engages a distal surface of wireline cable cutting mechanism 410, thereby actuating wireline cable cutting mechanism 410 and thus cutting wireline cable 401. Relaxation of the tensile load applied to wireline cable 401 prior to actuation of wireline cable cutting mechanism 410 may cause this progressive sequence to be reversed from the point at which the tensile load is reduced. In operation, cable-head cutter tool 200 may provide an operator with an ability to cut wireline cable 401 through an increase in tensile load applied to wireline cable 401 which may cause wireline cable 401 to become stretched and cause a rapid release of inertia built-up within cable-head cutter tool 200, thereby cutting wireline cable 401 by means of sudden impact once mandrel system 249 becomes freed.

In the third embodiment, as cable-head cutter tool 300 begins to undertake a progressive sequence toward causing wireline cable cutting mechanism 410 to cut wireline cable 401, initial travel of mandrel system 349 in a proximal direction may cause a proximal surface of dog clutch, load release latch, or collet 391 to engage a distal surface of compression ring 371. Continued travel of mandrel system 349 in a proximal direction may next cause biasing element 369 to become increasingly compressed, and thus increasingly resist continued travel of mandrel system 349. If the tensile load applied to wireline cable 401 is sufficient to overcome the increasing resistance of biasing element 369, release mechanism, dog clutch, load release latch, or collet 391 may come into alignment with and expand to register against trigger sleeve 394 and thus free mandrel system 349 to travel in a proximal direction. Upon being freed by triggering mechanism 390, continued travel of mandrel system 349 in a proximal direction may cause dog clutch, load release latch, or collet 382 to act against compression ring 381 which may in turn engage a distal surface of pressure piston assembly 363. Continued travel of mandrel system 349 in a proximal direction may next cause biasing element 361 to become increasingly compressed, and thus increasingly resist continued travel of mandrel system 349 as working fluid passes through pressure piston assembly 363 from the proximal portion to the distal portion of the first annular fluid chamber. If the tensile load applied to wireline cable 401 is sufficient to overcome the increasing resistance of biasing element 361, release mechanism, dog clutch, load release latch, or collet 382 of triggering mechanism 380 may come into alignment with and expand to register against trigger sleeve 385 and thus free mandrel system 349 to travel unrestrained in a proximal direction until a proximal surface of cutter press 340 engages a distal surface of wireline cable cutting mechanism 410, thereby actuating wireline cable cutting mechanism 410 and thus cutting wireline cable 401. Relaxation of the tensile load applied to wireline cable 401 prior to actuation of wireline cable cutting mechanism 410 may cause this progressive sequence to be reversed from the point at which the tensile load is reduced. In operation, cable-head cutter tool 300 may provide an operator with an ability to stage the application of an increased tensile load on wireline cable 401, whereby triggering mechanism 390 may provide a relatively shorter time delay which may be overcome through application of a first, relatively high tensile load, thereby "opening the door" to cutting wireline cable 401, and triggering mechanism 380 may provide a relatively longer time delay which may be overcome through application of a tensile load which may be higher or lower than the first tensile load applied to wireline cable 401, thereby cutting wireline cable 401.

The time-controlled cable-head cutter for line conveyed tools, embodiments, and methods just described may provide a number of features and benefits not presently available in the art. Such features and benefits may include a cable cutter disposed internally within a housing, which may allow the cable, once cut, to be retrieved free of tool string equipment, with the stuck tool string providing an unobstructed fishing neck available for subsequent retrieval. Additionally, the time-controlled cable-head cutter may be configured to be activated based upon a predetermined or desired tensile load being applied to a wireline cable, a predetermined or desired time delay following application of a tensile load to a wireline cable, or combinations thereof. In this manner, and in combination with the ability to reset the time-controlled cable-head cutter, an operator may be able to perform an unlimited number of safe, high-tension pulls or may be able to perform numerous wireline runs without the need to re-head the wireline cable. Further, the time-controlled cable-head cutter may be insensitive to firing shocks from wireline conveyed perforating guns.

By providing an operator with the ability to adjust the release tension through the adjustment mandrel, the time-controlled cable-head cutter may offer operational benefits over prevailing alternatives whereby it may be necessary for an operator to have ready different sets of cable-heads having different release tensions. Additional operational benefits may be available in the embodiments of the time-controlled cable-head cutter, whereby an operator may be able to re-head a wireline cable without the need to disassemble the time-controlled cable-head cutter.

Although the present invention and its advantages have been described in detail, it should be understood that various changes, substitutions and alterations may be made herein without departing from the spirit and scope of the invention as defined by the appended claims.

What is claimed is:

1. A system comprising:

a cable head cutter tool comprising an outer housing, an outer housing connector, an internal mandrel, and a combination of mechanical and hydraulic devices disposed within the outer housing which act upon the mandrel, wherein the hydraulic devices comprise at least a pressure piston assembly which further comprises one or more metering orifices and at least one check valve;

a tool string connected to the outer housing connector;

a line connected to the internal mandrel;

wherein the internal mandrel is held biased into a first position within the outer housing by a resistance provided by the combination of mechanical and hydraulic devices;

wherein the internal mandrel is released from the first position by applying tension on the line which exceeds a release tension and then maintaining an applied tension for a duration which exceeds a release duration, until the internal mandrel is released from the outer housing;

wherein upon being released the internal mandrel travels toward a second position at which the internal mandrel contacts a line cutting mechanism disposed within the outer housing, causing the line cutting device to cut the line.

2. The system of claim 1, wherein the line is a slickline, a braided line, an electromechanical line, a flexible rod, or a coiled tubing.

3. The system of claim 1, wherein the line has a working tension limit and wherein the outer housing connector has a tensile strength limit greater than the working tension limit of the line.

4. The system of claim 1, wherein the line cutting mechanism may comprise a mechanical blade-based cutter, a ballistic cutter, or a chemical cutter.

5. The system of claim 1, wherein the line cutting mechanism is coupled to the internal mandrel, wherein upon being released the mandrel travels toward a second position at which the line cutting mechanism contacts an inner profile of the outer housing, causing the line cutting mechanism to cut the line.

6. The system of claim 1, wherein while applying the applied tension on the line and before the line cutting mechanism cuts the line, the mandrel may beis biased to the first position by reducing the applied tension.

7. A method of releasing a line from a tool string, comprising:

connecting a line to a cable head cutter tool using an anchoring method;

supporting a tool string in a well using the line;

applying tension to the line;

holding the applied tension for a duration;

releasing a mandrel of the cable head cutter tool from a first position when an applied tension exceeds a preset release tension and the duration of the applied tension exceeds a selected release duration, wherein the preset release tension and selected release duration are based upon a resistance provided by a combination of mechanical and hydraulic devices disposed within the cable head cutter tool which results in the line cutting mechanism cutting the line, wherein the hydraulic devices comprise at least a pressure piston assembly which further comprises one or more metering orifices and at least one check valve.

8. The method of claim 7, further comprising reducing the applied tension below the preset release tension before the selected release duration is exceeded, thereby allowing the mandrel to be biased toward the first position.

9. A cable head cutter tool for raising and lowering a tool string within a well using a line, comprising:

an outer housing comprising a connector adapted for connection to the tool string and an internal mandrel adapted for connection to the line;

one or more locking mechanisms in communication with the outer housing and the internal mandrel, each locking mechanism comprising a locked configuration and a released configuration, wherein in the released configuration the internal mandrel is free to travel independent of the locking mechanism, and wherein each of the one or more locking mechanisms communicates with the outer housing through a system of mechanical devices, hydraulic devices, or combinations thereof, thereby providing each of the one or more locking mechanisms with a release tension and a release duration, wherein the hydraulic devices comprise at least a pressure piston assembly which further comprises one or more metering orifices and at least one check valve; and a line cutting mechanism disposed within the outer housing which cuts the line upon the internal mandrel communicating with line cutting mechanism;

wherein each of the one or more locking mechanisms may be shifted from the locked configuration to the released configuration based upon a tension applied to the line exceeding a preset release tension of the locking mechanism and being held for a duration exceeding a selected release duration of the locking mechanism.

10. The apparatus of claim 9, wherein the line cutting mechanism is coupled to the internal mandrel, wherein upon being released the mandrel travels toward a second position causing the line cutting mechanism to cut the line.

11. The apparatus of claim 9, wherein a cutter of the line cutting mechanism may be driven by a compression force applied to the line cutting mechanism after the mandrel is released.

12. The apparatus of claim 9, wherein a cutter of the line cutting mechanism comprises a ballistic cutter or a chemical cutter.

* * * * *